US011352575B2

(12) United States Patent
Al-Ghrami et al.

(10) Patent No.: US 11,352,575 B2
(45) Date of Patent: Jun. 7, 2022

(54) PROCESSES FOR PRODUCING PETROCHEMICAL PRODUCTS THAT UTILIZE HYDROTREATING OF CYCLE OIL

(71) Applicant: Saudi Arabian Oil Company, Dhahran (SA)

(72) Inventors: Musaed Salem Al-Ghrami, Dhahran (SA); Aaron Chi Akah, Dhahran (SA); Abdennour Bourane, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/009,012

(22) Filed: Sep. 1, 2020

(65) Prior Publication Data

US 2022/0064553 A1 Mar. 3, 2022

(51) Int. Cl.
*C10G 69/06* (2006.01)
*C10G 11/20* (2006.01)
(Continued)

(52) U.S. Cl.
CPC ..... *C10G 69/06* (2013.01); *C10G 11/182* (2013.01); *C10G 11/20* (2013.01); *C10G 69/04* (2013.01);
(Continued)

(58) Field of Classification Search
CPC ..... C10G 69/06; C10G 11/20; C10G 11/182; C10G 2400/20; C10G 2300/202; C10G 2300/4081; C10G 2300/205; C10G 2400/30; C10G 2300/807; C10G 2300/701; C10G 69/04
See application file for complete search history.

(56) References Cited

U.S. PATENT DOCUMENTS 977,228 A 11/1910 Benjamin
2,882,218 A 4/1959 Jewell
(Continued)

FOREIGN PATENT DOCUMENTS

CN 1710029 A 12/2005
CN 102925210 A 2/2013
(Continued)

OTHER PUBLICATIONS

Christie John Geankoplis, Transport Processes and Separation Process Principles, Pearson Education International, 4th, p. 702 (Year: 2003).*
(Continued)

*Primary Examiner* — Randy Boyer
*Assistant Examiner* — Juan C Valencia
(74) *Attorney, Agent, or Firm* — Dinsmore & Shohl LLP

(57) ABSTRACT

According to one or more embodiments, presently disclosed are processes for producing petrochemical products from a hydrocarbon material. The process may include separating the hydrocarbon material into at least a lesser boiling point fraction and a greater boiling point fraction, cracking at least a portion of the greater boiling point fraction, cracking at least a portion of the lesser boiling point fraction, separating cycle oil from one or both of the first cracking reaction product or the second cracking reaction product, hydrotreating the cycle oil to form a hydrotreated cycle oil, and recycling the hydrotreated cycle oil.

24 Claims, 4 Drawing Sheets

(51) Int. Cl.
*C10G 11/18* (2006.01)
*C10G 69/04* (2006.01)

(52) U.S. Cl.
CPC . *C10G 2300/202* (2013.01); *C10G 2300/205* (2013.01); *C10G 2300/4081* (2013.01); *C10G 2300/701* (2013.01); *C10G 2300/807* (2013.01); *C10G 2400/20* (2013.01); *C10G 2400/30* (2013.01)

(56) References Cited

U.S. PATENT DOCUMENTS 3,074,878 A 1/1963 Pappas
3,835,029 A 9/1974 Larson
3,837,822 A 9/1974 Ward
3,856,659 A 12/1974 Owen
3,888,762 A 6/1975 Gerhold
4,090,949 A 5/1978 Owen et al.
4,297,203 A 10/1981 Ford et al.
4,417,975 A 11/1983 Myers
4,419,221 A 12/1983 Castagnos et al.
4,436,613 A 3/1984 Sayles et al.
4,464,250 A 8/1984 Myers et al.
4,606,810 A 8/1986 Krambeck et al.
4,830,728 A 5/1989 Herbst et al.
4,980,053 A 12/1990 Li et al.
4,992,160 A 2/1991 Long et al.
5,026,935 A 6/1991 Leyshon et al.
5,026,936 A 6/1991 Leyshon et al.
5,043,522 A 8/1991 Leyshon et al.
5,154,818 A 10/1992 Harandi et al.
5,158,919 A 10/1992 Haddad et al.
5,160,424 A 11/1992 Le et al.
5,171,921 A 12/1992 Gaffney et al.
5,232,580 A 8/1993 Le et al.
5,232,675 A 8/1993 Shu et al.
5,318,689 A 6/1994 Hsing et al.
5,326,465 A 7/1994 Yongqing et al.
5,334,554 A 8/1994 Lin et al.
5,372,704 A 12/1994 Harandi et al.
5,380,690 A 1/1995 Zhicheng et al.
5,451,313 A 9/1995 Wegerer et al.
5,462,652 A 10/1995 Wegerer
5,523,502 A 6/1996 Rubin
5,549,813 A 8/1996 Dai et al.
5,589,139 A 12/1996 Zinke et al.
5,597,537 A 1/1997 Wegerer et al.
5,637,207 A 6/1997 Hsing et al.
5,670,037 A 9/1997 Zaiting et al.
5,685,972 A 11/1997 Timken et al.
5,730,859 A 3/1998 Johnson et al.
5,770,042 A 6/1998 Galperin et al.
5,858,207 A 1/1999 Lomas
5,904,837 A 5/1999 Fujiyama
5,951,850 A 9/1999 Ino et al.
5,976,356 A 11/1999 Drake et al.
5,993,642 A 11/1999 Mohr et al.
6,015,933 A 1/2000 Abrevaya et al.
6,069,287 A 5/2000 Ladwig et al.
6,210,562 B1 4/2001 Xie et al.
6,287,522 B1 9/2001 Lomas
6,288,298 B1 9/2001 Rodriguez et al.
6,300,537 B1 10/2001 Strohmaier et al.
6,315,890 B1 11/2001 Ladwig et al.
6,420,621 B2 7/2002 Sha et al.
6,455,750 B1 9/2002 Steffens et al.
6,521,563 B2 2/2003 Strohmaier et al.
6,548,725 B2 4/2003 Froment et al.
6,566,293 B1 5/2003 Vogt et al.
6,602,403 B1 8/2003 Steffens et al.
6,652,737 B2 11/2003 Touvelle et al.
6,656,345 B1 12/2003 Chen et al.
6,656,346 B2 12/2003 Ino et al.
6,784,329 B2 8/2004 O'Rear et al.
6,867,341 B1 3/2005 Abrevaya et al.
6,979,755 B2 12/2005 O'Rear et al.
7,019,187 B2 3/2006 Powers
7,029,571 B1 4/2006 Bhattacharyya et al.
7,087,154 B2 8/2006 Pinho et al.
7,087,155 B1 8/2006 Dath et al.
7,128,827 B2 10/2006 Tailman et al.
7,153,479 B2 12/2006 Peterson et al.
7,169,293 B2 1/2007 Lomas et al.
7,220,351 B1 5/2007 Pontier et al.
7,261,807 B2 8/2007 Henry et al.
7,270,739 B2 9/2007 Chen et al.
7,312,370 B2 12/2007 Pittman et al.
7,314,964 B2 1/2008 Abrevaya et al.
7,326,332 B2 2/2008 Chen et al.
7,374,660 B2 5/2008 Steffens et al.
7,459,596 B1 12/2008 Abrevaya et al.
7,479,218 B2 1/2009 Letzsch
7,686,942 B2 3/2010 Xie et al.
7,906,077 B2 3/2011 Sandacz
7,935,654 B2 5/2011 Choi et al.
8,137,533 B2 3/2012 Towler et al.
8,247,631 B2 8/2012 Nicholas et al.
8,614,160 B2 12/2013 Upson et al.
8,864,979 B2 10/2014 Palmas
8,933,286 B2 1/2015 Souza et al.
9,096,806 B2 8/2015 Abba et al.
9,101,854 B2 8/2015 Koseoglu et al.
9,290,705 B2 3/2016 Bourane et al.
9,783,749 B2 10/2017 Davydov
9,816,037 B2 11/2017 Avais
2001/0042700 A1 11/2001 Swan, III et al.
2001/0056217 A1 12/2001 Froment et al.
2002/0003103 A1 1/2002 Henry et al.
2003/0220530 A1 11/2003 Boelt et al.
2005/0070422 A1 3/2005 Chen et al.
2005/0150817 A1 7/2005 Tailman et al.
2006/0108260 A1 5/2006 Henry
2008/0011644 A1 1/2008 Dean et al.
2008/0011645 A1 1/2008 Dean
2008/0035527 A1 2/2008 Eng et al.
2008/0044611 A1 2/2008 Husemann et al.
2009/0012339 A1 1/2009 Choi et al.
2009/0112035 A1 4/2009 Choi et al.
2009/0288990 A1 11/2009 Xie et al.
2011/0000818 A1* 1/2011 Xu ..... C10G 67/0409 208/70
2011/0139679 A1 6/2011 Bories et al.
2012/0241359 A1 9/2012 Al-Thubaiti et al.
2013/0001130 A1 1/2013 Mo
2013/0056393 A1 3/2013 Subramani et al.
2013/0172643 A1 7/2013 Pradeep et al.
2013/0248420 A1 9/2013 Palmas
2013/0248421 A1* 9/2013 Abba ..... C10G 69/04 208/80
2014/0110308 A1 4/2014 Bourane et al.
2014/0228205 A1 8/2014 Narayanaswamy et al.
2015/0094511 A1 4/2015 Bastianti et al.
2015/0361351 A1* 12/2015 Banerjee ..... C10G 21/20 208/57
2016/0333280 A1 11/2016 Subramani et al.
2017/0130140 A1 5/2017 Bhanuprasad et al.
2017/0190991 A1 7/2017 Sundberg et al.
2018/0057758 A1 3/2018 Al-Ghamdi et al.
2018/0079974 A1* 3/2018 Kokayeff ..... C10G 69/04
2018/0142167 A1 5/2018 Al-Ghamdi et al.
2018/0223193 A1* 8/2018 Kukade ..... C10G 11/182
2018/0305623 A1 10/2018 Al-Ghrami et al.
2018/0327677 A1 11/2018 Ding et al.
2018/0346827 A1* 12/2018 Al-Ghamdi ..... B01J 8/1809
2019/0119586 A1 4/2019 Gong et al.
2019/0225894 A1 7/2019 Bourane et al.
2020/0255753 A1 8/2020 Al-Herz et al.
2021/0047573 A1 2/2021 Bourane et al.

FOREIGN PATENT DOCUMENTS

EP 315179 A1 5/1989
EP 2688982 A1 1/2014
GB 978576 12/1964

(56) References Cited

FOREIGN PATENT DOCUMENTS

| | | | |
|---|---|---|---|
| WO | 2010053482 | A1 | 5/2010 |
| WO | 2012128973 | A1 | 9/2012 |
| WO | 2016096502 | A1 | 6/2016 |
| WO | 2016096970 | A1 | 6/2016 |
| WO | 2019106921 | A1 | 6/2019 |

OTHER PUBLICATIONS

Office Action dated Mar. 16, 2021 pertaining to U.S. Appl. No. 17/009,073, filed Sep. 1, 2020, 27 pgs.
Corma, "A new continuous laboratory reactor for the study of catalytic cracking", Applied Catalysis A: General 232, pp. 247-263, 2002.
International Search Report and Written Opinion pertaining to International Application PCT/US2018/030858 dated May 3, 2018.
Corma et al., "Different process schemes for converting light straight run and fluid catalytic cracing naphthas in a FCC unit for maximum propylene production", Applied Catalyst A: General 265, pp. 195-206, 2004.
Verstraete et al., "Study of direct and indirect naphtha recycling to a resid FCC unit for maximum propylene production", Catalysis Today, 106, pp. 62-71, 2005.
International Search Report and Written Opinion dated Apr. 4, 2019 pertaining to International application No. PCT/US2019/013978 filed Jan. 17, 2019, 19 pgs.
Corma et al., "Steam catalytic cracking of naphtha over ZSM-5 zeolite for production of propene and ethene: Micro and mascroscopic implications of the presence of steam", Applied Catalysis A: General 417-418, pp. 220-235, 2012.
Examination Report pertaining to Application No. GC2018-35391 dated Nov. 27, 2019.
Office Action dated Nov. 15, 2019 pertaining to U.S. Appl. No. 16/244,181, filed Jan. 10, 2019, 41 pgs.
Office Action dated May 13, 2020 pertaining to U.S. Appl. No. 15/945,362, filed Apr. 4, 2018, 55 pgs.
Office Action dated May 26, 2020 pertaining to U.S. Appl. No. 16/244,181, filed Jan. 10, 2019, 22 pgs.
Notice of Allowance dated Aug. 19, 2020 pertaining to U.S. Appl. No. 15/945,362, filed Apr. 4, 2018, 9 pgs.
Notice of Allowance dated Sep. 4, 2020 pertaining to U.S. Appl. No. 16/244,181, filed Jan. 10, 2019, 15 pgs.
International Search Report and Written Opinion dated May 3, 2021 pertaining to International application No. PCT/US2021/015012 filed Jan. 26, 2021, 12 pages.
International Search Report and Written Opinion dated May 3, 2021 pertaining to International application No. PCT/US2021/015007 filed Jan. 26, 2021, 15 pages.
International Search Report and Written Opinion dated May 3, 2021 pertaining to International application No. PCT/US2021/015010 filed Jan. 26, 2021, 13 pages.
International Search Report and Written Opinion dated May 10, 2021 pertaining to International application No. PCT/US2021/015013 filed Jan. 26, 2021, 14 pages.
International Search Report and Written Opinion dated May 10, 2021 pertaining to International application No. PCT/US2021/015035 filed Jan. 26, 2021, 15 pages.
International Search Report and Written Opinion dated May 10, 2021 pertaining to International application No. PCT/US2021/015019 filed Jan. 26, 2021, 15 pages.
Office Action dated Jun. 7, 2021 pertaining to U.S. Appl. No. 17/009,008, filed Sep. 1, 2020, 28 pages.
Office Action dated Jun. 8, 2021 pertaining to U.S. Appl. No. 17/009,048, filed Sep. 1, 2020, 28 pages.
Office Action dated Jun. 10, 2021 pertaining to U.S. Appl. No. 17/009,039, filed Sep. 1, 2020, 39 pages.
Office Action dated Jul. 6, 2021 pertaining to U.S. Appl. No. 17/009,020, filed Sep. 1, 2020, 41 pages.
Office Action dated Jul. 2, 2021 pertaining to U.S. Appl. No. 17/009,073, filed Sep. 1, 2020, 18 pages.
International Search Report and Written Opinion dated Jun. 16, 2021 pertaining to International application No. PCT/US2021/015030 filed Jan. 26, 2021, 15 pages.

* cited by examiner

PROCESSES FOR PRODUCING PETROCHEMICAL PRODUCTS THAT UTILIZE HYDROTREATING OF CYCLE OIL

TECHNICAL FIELD

Embodiments of the present disclosure generally relate to chemical processing and, more specifically, to processes and systems utilizing fluid catalytic cracking to form olefins.

BACKGROUND

Ethylene, propene, butene, butadiene, and aromatics compounds such as benzene, toluene and xylenes are basic intermediates for a large proportion of the petrochemical industry. They are usually obtained through the thermal cracking (or steam pyrolysis) of petroleum gases and distillates such as naphtha, kerosene or even gas oil. These compounds are also produced through a refinery fluidized catalytic cracking (FCC) process where classical heavy feedstocks such as gas oils or residues are converted. Typical FCC feedstocks range from hydrocracked bottoms to heavy feed fractions such as vacuum gas oil and atmospheric residue; however, these feedstocks are limited. The second most important source for propene production is currently refinery propene from FCC units. With the ever growing demand, FCC unit owners look increasingly to the petrochemicals market to boost their revenues by taking advantage of economic opportunities that arise in the propene market.

The worldwide increasing demand for light olefins remains a major challenge for many integrated refineries. In particular, the production of some valuable light olefins such as ethylene, propene, and butene has attracted increased attention as pure olefin streams are considered the building blocks for polymer synthesis. The production of light olefins depends on several process variables like the feed type, operating conditions, and the type of catalyst.

SUMMARY

Despite the options available for producing a greater yield of propene and other light olefins, intense research activity in this field is still being conducted. These options include the use of high severity fluid catalytic cracking ("HSFCC") systems, developing more selective catalysts for the process, and enhancing the configuration of the process in favor of more advantageous reaction conditions and yields. The HSFCC process is capable of producing yields of propene up to four times greater than the traditional fluid catalytic cracking unit and greater conversion levels for a range of petroleum streams. Embodiments of the present disclosure are directed to improved HSFCC systems and processes for producing one or more petrochemical products from a hydrocarbon material, such as a crude oil.

Some HSFCC systems may include recycling of cycle oil that is separated from the products of the HSFCC reactors. However, the cycle oil may contain impurities such as metal, sulfur, and nitrogen, which may poison the catalysts in the one or more HSFCC reactors and adversely impact the yield of petrochemical products from the HSFCC system. The presently-described processes for producing petrochemical products, which may include hydrotreating cycle oil prior to it being reintroduced into the system, may have a great influence on the conversion of a hydrocarbon material into light olefins, such as ethylene and propylene. Hydrotreating cycle oil may help to remove impurities, improve the hydrogen content, improve the crackability of the cycle oil, or combinations of these.

According to one or more embodiments, a process for producing petrochemical products from a hydrocarbon material may comprise separating the hydrocarbon material into at least a lesser boiling point fraction and a greater boiling point fraction, cracking at least a portion of the greater boiling point fraction in the presence of a first catalyst at a reaction temperature of from 500° C. to 700° C. to produce a first cracking reaction product, cracking at least a portion of the lesser boiling point fraction in the presence of a second catalyst at a reaction temperature of from 500° C. to 700° C. to produce a second cracking reaction product, separating cycle oil from one or both of the first cracking reaction product or the second cracking reaction product, where at least 99 wt. % of the cycle oil has a boiling point of at least 215° C., hydrotreating the cycle oil to form a hydrotreated cycle oil, and recycling the hydrotreated cycle oil by combining the hydrotreated cycle oil with the greater boiling point fraction upstream of the cracking of the greater boiling point fraction.

According to one or more additional embodiments, a process for operating a hydrocarbon feed conversion system for producing petrochemical products from a hydrocarbon feed stream may comprise introducing the hydrocarbon feed stream to a feed separator, separating the hydrocarbon feed stream into at least a lesser boiling point fraction stream and a greater boiling point fraction stream in the feed separator, passing the greater boiling point fraction stream to a first fluidized catalytic cracking (FCC) unit, passing the lesser boiling point fraction stream to a second FCC unit, cracking at least a portion of the greater boiling point fraction stream in the first FCC unit in the presence of a first catalyst at a reaction temperature of from 500° C. to 700° C. to produce a first cracking reaction product stream, cracking at least a portion of the lesser boiling point fraction stream in the second FCC unit in the presence of a second catalyst and at a reaction temperature of from 500° C. to 700° C. to produce a second cracking reaction product stream, separating a cycle oil stream from one or both of the first cracking reaction product stream or the second cracking reaction product stream, where at least 99 wt. % of the cycle oil stream has a boiling point of at least 215° C., hydrotreating the cycle oil stream to form a hydrotreated cycle oil stream, and recycling the hydrotreated cycle oil stream by combining the hydrotreated cycle oil with the greater boiling point fraction upstream of the first FCC unit.

Additional features and advantages of the described embodiments will be set forth in the detailed description which follows, and in part will be readily apparent to those skilled in the art from that description or recognized by practicing the described embodiments, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Figure 1:
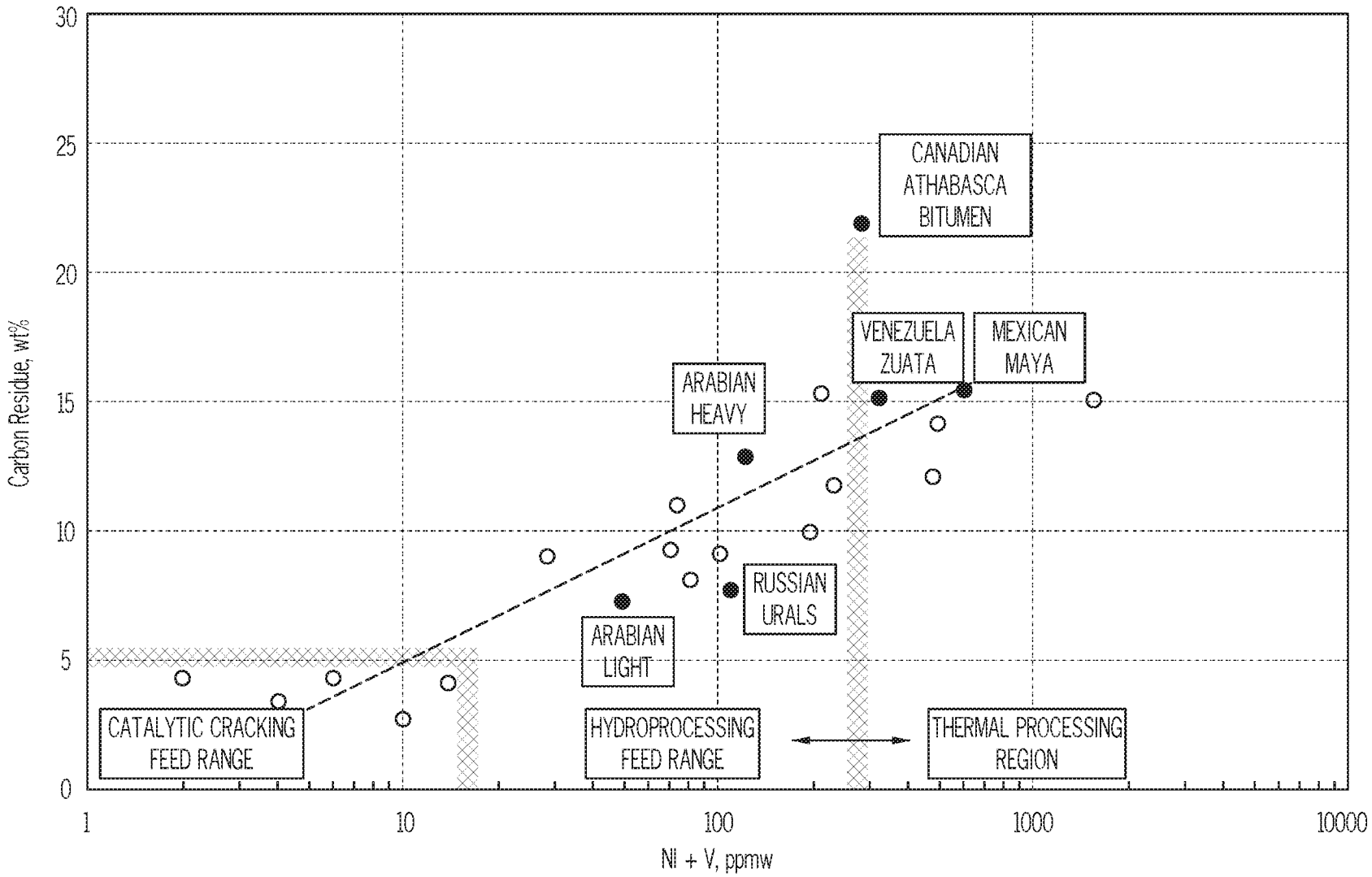
FIG. 1 graphically depicts relative properties of various hydrocarbon feed streams used for producing one or more petrochemical products, according to one or more embodiments described in this disclosure.

For the purpose of describing the simplified schematic illustrations and descriptions of the relevant figures, the numerous valves, temperature sensors, electronic controllers and the like that may be employed and well known to those of ordinary skill in the art of certain chemical processing operations are not included. Further, accompanying components that are often included in typical chemical processing operations, such as air supplies, catalyst hoppers, and flue gas handling systems, are not depicted. Accompanying components that are in hydrocracking units, such as bleed streams, spent catalyst discharge subsystems, and catalyst replacement sub-systems are also not shown. It should be understood that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines which may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows which do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that according to the embodiments presented in the relevant figures, an arrow between two system components may signify that the stream is not processed between the two system components. In other embodiments, the stream signified by the arrow may have substantially the same composition throughout its transport between the two system components. Additionally, it should be understood that in one or more embodiments, an arrow may represent that at least 75 wt. %, at least 90 wt. %, at least 95 wt. %, at least 99 wt. %, at least 99.9 wt. %, or even 100 wt. % of the stream is transported between the system components. As such, in some embodiments, less than all of the streams signified by an arrow may be transported between the system components, such as if a slip stream is present.

It should be understood that two or more process streams are "mixed" or "combined" when two or more lines intersect in the schematic flow diagrams of the relevant figures. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments of the present disclosure are directed to systems and processes for converting one or more hydrocarbon feed streams into one or more petrochemical products using a high-severity fluidized catalytic cracking (HSFCC) system that includes two downflow fluid catalytic cracking (FCC) units operated at high-severity conditions. For example, a method for operating a system having a first FCC unit and a second FCC unit may include separating the hydrocarbon feed stream into a lesser boiling point fraction and a greater boiling point fraction in the feed separator. The greater boiling point fraction may be introduced to a first cracking reaction zone, in which the greater boiling point fraction is mixed with a first catalyst and cracked to produce a first cracking reaction product. The lesser boiling point fraction may be introduced to a second cracking reaction zone, in which the lesser boiling point fraction is mixed with a second catalyst and cracked to produce a second cracking reaction product. Cycle oil may be separated from one or both of the first cracking reaction product or the second cracking reaction product. The cycle oil may be hydrotreated to form a hydrotreated cycle oil. The hydrotreated cycle oil may be recycled by combining the hydrotreated cycle oil with the greater boiling point fraction upstream of the cracking of the greater boiling point fraction.

As used in this disclosure, a "reactor" refers to a vessel in which one or more chemical reactions may occur between one or more reactants optionally in the presence of one or more catalysts. For example, a reactor may include a tank or tubular reactor configured to operate as a batch reactor, a continuous stirred-tank reactor (CSTR), or a plug flow reactor. Example reactors include packed bed reactors such as fixed bed reactors, and fluidized bed reactors. One or more "reaction zones" may be disposed in a reactor. As used in this disclosure, a "reaction zone" refers to an area where a particular reaction takes place in a reactor. For example, a packed bed reactor with multiple catalyst beds may have multiple reaction zones, where each reaction zone is defined by the area of each catalyst bed.

As used in this disclosure, a "separation unit" refers to any separation device or system of separation devices that at least partially separates one or more chemicals that are mixed in a process stream from one another. For example, a separation unit may selectively separate differing chemical species, phases, or sized material from one another, forming one or more chemical fractions. Examples of separation units include, without limitation, distillation columns, flash drums, knock-out drums, knock-out pots, centrifuges, cyclones, filtration devices, traps, scrubbers, expansion devices, membranes, solvent extraction devices, and the like. It should be understood that separation processes described in this disclosure may not completely separate all of one chemical constituent from all of another chemical constituent. It should be understood that the separation processes described in this disclosure "at least partially" separate different chemical components from one another, and that even if not explicitly stated, it should be understood that separation may include only partial separation. As used in this disclosure, one or more chemical constituents may be "separated" from a process stream to form a new process stream. Generally, a process stream may enter a separation unit and be divided, or separated, into two or more process streams of desired composition. Further, in some separation processes, a "lesser boiling point fraction" (sometimes referred to as a "light fraction") and a "greater boiling point fraction" (sometimes referred to as a "heavy fraction") may exit the separation unit, where, on average, the contents of the lesser boiling point fraction stream have a lesser boiling point than the greater boiling point fraction stream. Other streams may fall between the lesser boiling point fraction and the greater boiling point fraction, such as an "intermediate boiling point fraction."

As used in this disclosure, the term "high-severity conditions" generally refers to FCC temperatures of 500° C. or greater, a weight ratio of catalyst to hydrocarbon (catalyst to oil ratio) of equal to or greater than 5:1, and a residence time of less than 3 seconds, all of which may be more severe than typical FCC reaction conditions.

It should be understood that an "effluent" generally refers to a stream that exits a system component such as a separation unit, a reactor, or reaction zone, following a particular reaction or separation, and generally has a different composition (at least proportionally) than the stream that entered the separation unit, reactor, or reaction zone.

As used in this disclosure, a "catalyst" refers to any substance that increases the rate of a specific chemical reaction. Catalysts described in this disclosure may be utilized to promote various reactions, such as, but not limited to, cracking (including aromatic cracking), demetalization, desulfurization, and denitrogenation. As used in this disclosure, "cracking" generally refers to a chemical reaction where carbon-carbon bonds are broken. For example, a molecule having carbon to carbon bonds is broken into more than one molecule by the breaking of one or more of the carbon to carbon bonds, or is converted from a compound which includes a cyclic moiety, such as a cycloalkane, cycloalkane, naphthalene, an aromatic or the like, to a compound which does not include a cyclic moiety or contains fewer cyclic moieties than prior to cracking.

As used in this disclosure, the term "first catalyst" refers to catalyst that is introduced to the first cracking reaction zone, such as the catalyst passed from the first catalyst/feed mixing zone to the first cracking reaction zone. The first catalyst may include at least one of regenerated catalyst, spent first catalyst, spent second catalyst, fresh catalyst, or combinations of these. As used in this disclosure, the term "second catalyst" refers to catalyst that is introduced to the second cracking reaction zone, such as the catalyst passed from the second catalyst/feed mixing zone to the second cracking reaction zone for example. The second catalyst may include at least one of regenerated catalyst, spent first catalyst, spent second catalyst, fresh catalyst, or combinations of these.

As used in this disclosure, the term "spent catalyst" refers to catalyst that has been introduced to and passed through a cracking reaction zone to crack a hydrocarbon material, such as the greater boiling point fraction or the lesser boiling point fraction for example, but has not been regenerated in the regenerator following introduction to the cracking reaction zone. The "spent catalyst" may have coke deposited on the catalyst and may include partially coked catalyst as well as fully coked catalysts. The amount of coke deposited on the "spent catalyst" may be greater than the amount of coke remaining on the regenerated catalyst following regeneration.

As used in this disclosure, the term "regenerated catalyst" refers to catalyst that has been introduced to a cracking reaction zone and then regenerated in a regenerator to heat the catalyst to a greater temperature, oxidize and remove at least a portion of the coke from the catalyst to restore at least a portion of the catalytic activity of the catalyst, or both. The "regenerated catalyst" may have less coke, a greater temperature, or both compared to spent catalyst and may have greater catalytic activity compared to spent catalyst. The "regenerated catalyst" may have more coke and lesser catalytic activity compared to fresh catalyst that has not passed through a cracking reaction zone and regenerator.

It should further be understood that streams may be named for the components of the stream, and the component for which the stream is named may be the major component of the stream (such as comprising from 50 weight percent (wt. %), from 70 wt. %, from 90 wt. %, from 95 wt. %, from 99 wt. %, from 99.5 wt. %, or even from 99.9 wt. % of the contents of the stream to 100 wt. % of the contents of the stream). It should also be understood that components of a stream are disclosed as passing from one system component to another when a stream comprising that component is disclosed as passing from that system component to another. For example, a disclosed "propylene stream" passing from a first system component to a second system component should be understood to equivalently disclose "propylene" passing from a first system component to a second system component, and the like.

The hydrocarbon feed stream may generally comprise a hydrocarbon material. In embodiments, the hydrocarbon material of the hydrocarbon feed stream may be crude oil. As used in this disclosure, the term "crude oil" is to be understood to mean a mixture of petroleum liquids, gases, solids, or combinations of these, including in some embodiments impurities such as sulfur-containing compounds, nitrogen-containing compounds and metal compounds that has not undergone significant separation or reaction processes. Crude oils are distinguished from fractions of crude oil. In certain embodiments the crude oil feedstock may be a minimally treated light crude oil to provide a crude oil feedstock having total metals (Ni+V) content of less than 5 parts per million by weight (ppmw) and Conradson carbon residue of less than 5 wt %.

Figure 2:
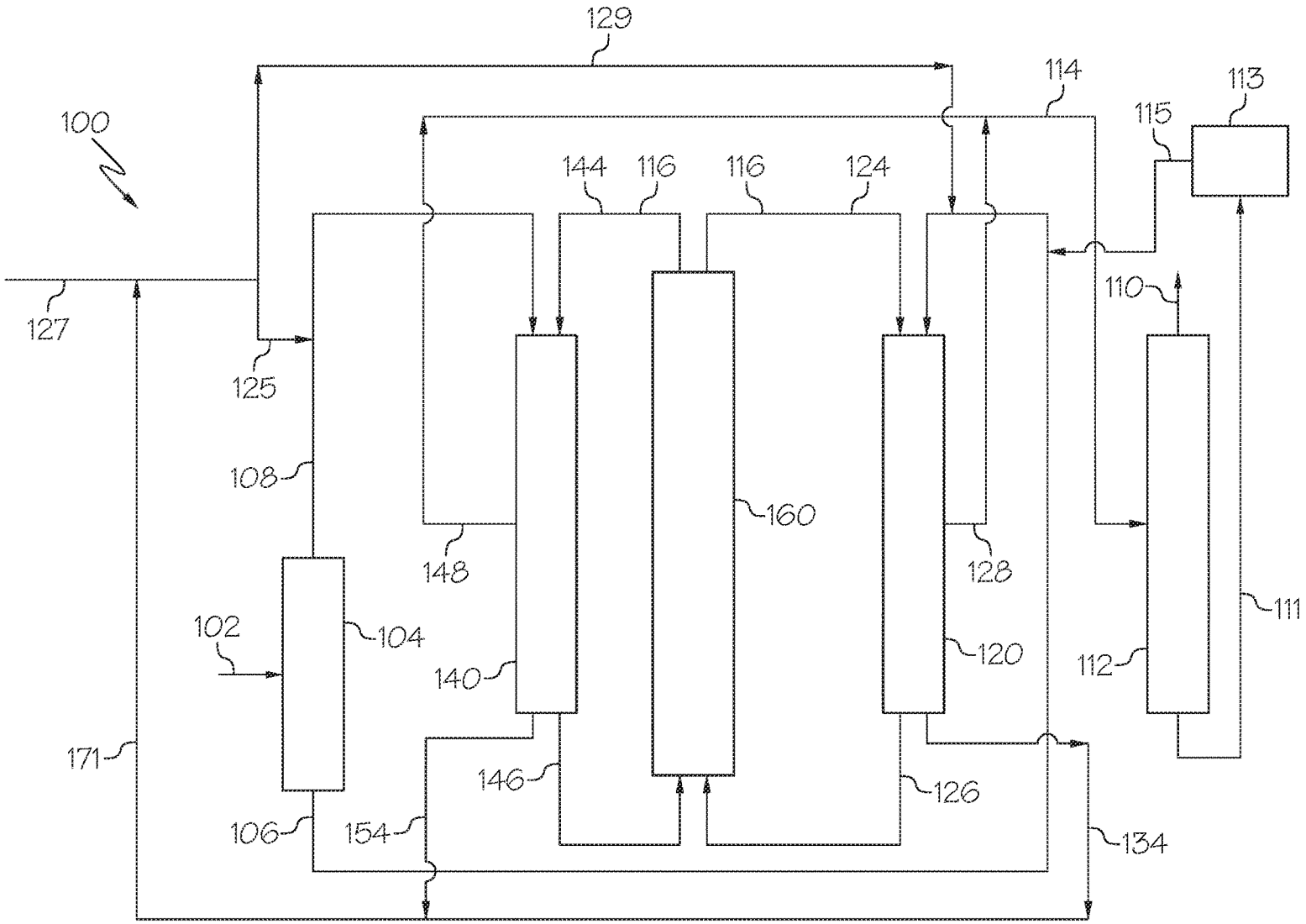
FIG. 2 is a generalized schematic diagram of a hydrocarbon feed conversion system, according to one or more embodiments described in this disclosure.
Figure 3:
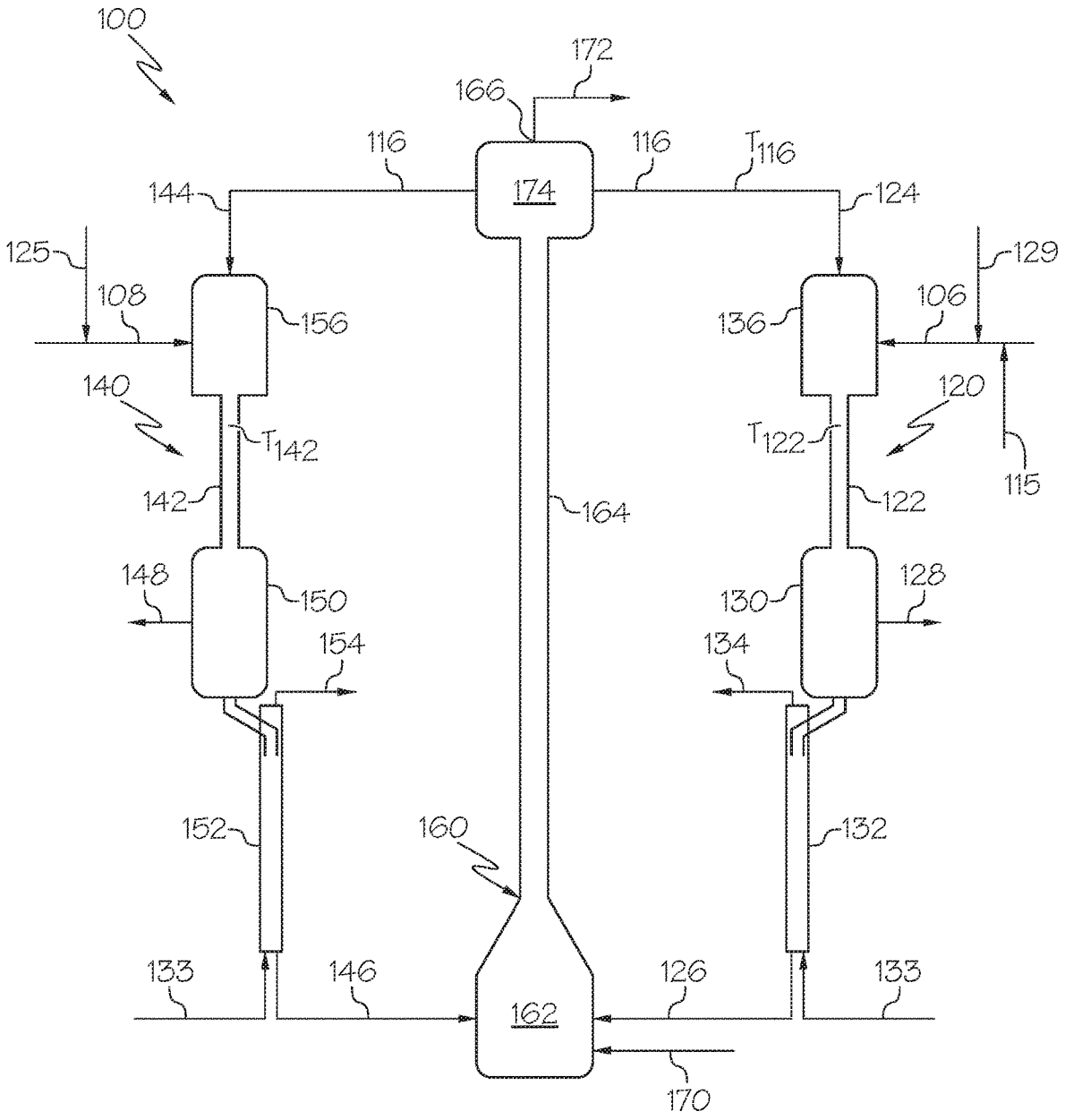
FIG. 3 depicts a schematic diagram of at least a portion of the hydrocarbon feed conversion system of FIG. 2, according to one or more embodiments described in this disclosure.

While the present description and examples may specify crude oil as the hydrocarbon material of the hydrocarbon feed stream 102, it should be understood that the hydrocarbon feed conversion systems 100 described with respect to the embodiments of FIGS. 2-3, respectively, may be applicable for the conversion of a wide variety of hydrocarbon materials, which may be present in the hydrocarbon feed stream 102, including, but not limited to, crude oil, vacuum residue, tar sands, bitumen, atmospheric residue, vacuum gas oils, demetalized oils, naphtha streams, other hydrocarbon streams, or combinations of these materials. The hydrocarbon feed stream 102 may include one or more non-hydrocarbon constituents, such as one or more heavy metals, sulphur compounds, nitrogen compounds, inorganic components, or other non-hydrocarbon compounds. If the hydrocarbon feed stream 102 is crude oil, it may have an American Petroleum Institute (API) gravity of from 22 degrees to 40 degrees. For example, the hydrocarbon feed stream 102 utilized may be an Arab heavy crude oil (API gravity of approximately 28°), Arab medium (API gravity of approximately 30°), Arab light (API gravity of approximately 33°), or Arab extra light (API gravity of approximately 39°). Example properties for one particular grade of Arab heavy crude oil are provided subsequently in Table 1. It should be understood that, as used in this disclosure, a "hydrocarbon feed" may refer to a raw hydrocarbon material which has not been previously treated, separated, or otherwise refined (such as crude oil) or may refer to a hydrocarbon material which has undergone some degree of processing, such as treatment, separation, reaction, purifying, or other operation, prior to being introduced to the hydrocarbon feed conversion system 100 in the hydrocarbon feed stream 102.

TABLE 1

Example of Arab Heavy Export Feedstock

| Analysis | Units | Value |
|---|---|---|
| American Petroleum Institute (API) gravity | degree | 27 |
| Density | grams per cubic centimeter ($g/cm^3$) | 0.8904 |
| Sulfur Content | weight percent (wt. %) | 2.83 |
| Nickel | parts per million by weight (ppmw) | 16.4 |
| Vanadium | ppmw | 56.4 |
| Sodium Chloride (NaCl) Content | ppmw | <5 |
| Conradson Carbon Residue (CCR) | wt. % | 8.2 |
| $C_5$ Asphaltenes | wt. % | 7.8 |
| $C_7$ Asphaltenes | wt. % | 4.2 |

In general, the contents of the hydrocarbon feed stream 102 may include a relatively wide variety of chemical species based on boiling point. For example, the hydrocarbon feed stream 102 may have composition such that the difference between the 5 wt. % boiling point and the 95 wt. % boiling point of the hydrocarbon feed stream 102 is at least 100° C., at least 200° C., at least 300° C., at least 400° C., at least 500° C., or even at least 600° C.

Referring to FIG. 1, various hydrocarbon feed streams to be converted in a conventional FCC process are generally required to satisfy certain criteria in terms of the metals content and the Conradson Carbon Residue (CCR) or Ramsbottom carbon content. The CCR of a feed material is a measurement of the residual carbonaceous materials that remain after evaporation and pyrolysis of the feed material. Greater metals content and CCR of a feed stream may lead to more rapid deactivation of the catalyst. For greater levels of CCR, more energy may be needed in the regeneration step to regenerate the catalyst. For example, certain hydrocarbon feeds, such as residual oils, contain refractory components such as polycyclic aromatics which are difficult to crack and promote coke formation in addition to the coke formed during the catalytic cracking reaction. Because of the greater levels of CCR of these certain hydrocarbon feeds, the burning load on the regenerator is increased to remove the coke and residue from the spent catalysts to transform the spent catalysts to regenerated catalysts. This requires modification of the regenerator to be able to withstand the increased burning load without experiencing material failure. In addition, certain hydrocarbon feeds to the FCC may contain large amounts of metals, such as nickel, vanadium, or other metals for example, which may rapidly deactivate the catalyst during the cracking reaction process.

In general terms, the hydrocarbon feed conversion system 100 includes two FCC units in each of which a portion of the hydrocarbon feed stream 102 contacts heated fluidized catalytic particles in a cracking reaction zone maintained at high-severity temperatures and pressures. When the portion of the hydrocarbon feed stream 102 contacts the hot catalyst and is cracked to lighter products, carbonaceous deposits, commonly referred to as coke, form on the catalyst. The coke deposits formed on the catalyst may reduce the catalytic activity of the catalyst or deactivate the catalyst. Deactivation of the catalyst may result in the catalyst becoming catalytically ineffective. The spent catalyst having coke deposits may be separated from the cracking reaction products, stripped of removable hydrocarbons, and passed to a regeneration process where the coke is burned from the catalyst in the presence of air to produce a regenerated catalyst that is catalytically effective. The term "catalytically effective" refers to the ability of the regenerated catalyst to increase the rate of cracking reactions. The term "catalytic activity" refers to the degree to which the regenerated catalyst increases the rate of the cracking reactions and may be related to a number of catalytically active sites available on the catalyst. For example, coke deposits on the catalyst may cover up or block catalytically active sites on the spent catalyst, thus, reducing the number of catalytically active sites available, which may reduce the catalytic activity of the catalyst. Following regeneration, the regenerated catalyst may have equal to or less than 10 wt. %, 5 wt. %, or even 1 wt. % coke based on the total weight of the regenerated catalyst. The combustion products may be removed from the regeneration process as a flue gas stream. The heated regenerated catalysts may then be recycled back to the cracking reaction zone of the FCC units.

Referring now to FIGS. 2 and 3, a hydrocarbon feed conversion system 100 is schematically depicted. The hydrocarbon feed conversion system 100 may be a high-severity fluid catalytic cracking (HSFCC) system. The hydrocarbon feed conversion system 100 generally receives a hydrocarbon feed stream 102 and directly processes the hydrocarbon feed stream 102 to produce one or more system product streams 110. The hydrocarbon feed conversion system 100 may include a feed separator 104, a first FCC unit 120, a second FCC unit 140, and a regenerator 160.

The hydrocarbon feed stream 102 may be introduced to the feed separator 104 which may separate the contents of the hydrocarbon feed stream 102 into at least a greater boiling point fraction stream 106 and a lesser boiling point fraction stream 108. In one or more embodiments, at least 90 wt. %, at least 95 wt. %, at least 99 wt. %, or even at least 99.9 wt. % of the hydrocarbon feed stream may be present in the combination of the greater boiling point fraction stream 106 and a lesser boiling point fraction stream 108. In one or more embodiments, the feed separator 104 may be a vapor-liquid separator such as a flash drum (sometimes referred to as a breakpot, knock-out drum, knock-out pot, compressor suction drum, or compressor inlet drum). In embodiments that utilize a vapor-liquid separator as the feed separator 104, the lesser boiling point fraction stream 108 may exit the feed separator 104 as a vapor and the greater boiling point fraction stream 106 may exit the feed separator 104 as a liquid. The vapor-liquid separator may be operated at a temperature and pressure suitable to separate the hydrocarbon feed stream 102 into the greater boiling point fraction stream 106 and the lesser boiling point fraction stream 108. The cut temperature or "cut point" (that is, the approximate atmospheric boiling point temperature separating the greater boiling point fraction stream 106 and the lesser boiling point fraction stream 108) of the vapor-liquid separator may be from 180 degrees Celsius (° C.) to 400° C. As such, all components of the lesser boiling point fraction stream may have a boiling point (at atmospheric pressure) of less than or equal to 400° C., less than or equal to 350° C., less than or equal to 300° C., less than or equal to 250° C., or less than or equal to 200° C., or even less than or equal to 180° C., and all components of the greater boiling point fraction stream may have a boiling point (at atmospheric pressure) of at least 180° C., at least 200° C., at least 250° C., at least 300° C., or at least 350° C., or even at least 400° C. The greater boiling point fraction stream 106 may also have equal to or greater than 3 wt. % micro carbon residue (MCR). The greater boiling point fraction stream 106 may have a specific gravity of equal to or greater than 0.88.

In one or more embodiments, the cut point may be approximately 350° C. In such embodiments, if Arab extra light crude is utilized as a feedstock, the 350° C.+ fraction may include 98.7 wt. % slurry oil, 0.8 wt. % light cycle oil, and 0.5 wt. % naphtha. In such embodiments, the 350° C.− fraction may include 57.5 wt. % naphtha, 38.9 wt. % light cycle oil, and 3.7 wt. % slurry oil.

In one or more embodiments, the feed separator 104 may be a flashing column that may separate the hydrocarbon feed stream 102 into the greater boiling point fraction stream 106 and the lesser boiling point fraction stream 108. The flashing column may be operated at a flashing temperature that results in the greater boiling point fraction stream 106 having less than 10 wt. % Conradson Carbon and less than 10 parts per million by weight (ppmw) total metals. In embodiments, the flashing column may be operated at a temperature of from 180° C. to 400° C. (if operated at atmospheric pressure), or other temperatures based on the pressure in the flashing column. Alternatively, in other embodiments, the feed separator 104 may include at least one of a distillation device or a cyclonic vapor liquid separation device.

One or more supplemental feed streams (not shown) may be added to the hydrocarbon feed stream 102 prior to introducing the hydrocarbon feed stream 102 to the feed separator 104. As previously described, in one or more embodiments, the hydrocarbon feed stream 102 may be crude oil. In one or more embodiments, the hydrocarbon feed stream 102 may be crude oil, and one or more supplemental feed streams comprising one or more of a vacuum residue, tar sands, bitumen, atmospheric residue, vacuum gas oils, demetalized oils, naphtha streams, other hydrocarbon streams, or combinations of these materials, may be added to the crude oil upstream of the feed separator 104.

Although some embodiments of the present disclosure focus on converting a hydrocarbon feed stream 102 that is a crude oil, the hydrocarbon feed stream 102 may alternatively comprise a plurality of refinery hydrocarbon streams outputted from one or more crude oil refinery operations. The plurality of refinery hydrocarbon streams may include a vacuum residue, an atmospheric residue, or a vacuum gas oil, for example. In some embodiments, the plurality of refinery hydrocarbon streams may be combined into the hydrocarbon feed stream 102. In these embodiments, the hydrocarbon feed stream 102 may be introduced to the feed separator 104 and separated into the greater boiling point fraction stream 106 and the lesser boiling point fraction stream 108. Alternatively, in some embodiments, the plurality of refinery hydrocarbon streams may be introduced directly to the first FCC unit 120, the second FCC unit 140, or both. For example, one or more heavy refinery hydrocarbon streams, such as vacuum residues, atmospheric residues, or vacuum gas oils, for example, may be introduced directly to the first FCC unit 120 as the greater boiling point fraction stream 106, and other light refinery hydrocarbon streams, such as a naphtha stream for example, may be introduced directly to the second FCC unit 140 as the lesser boiling point fraction stream 108.

Steam 127 may be introduced to the hydrocarbon feed conversion system 100. Steam 127 may be separated into steam 125, which may be introduced to the lesser boiling point fraction stream 108, and steam 129, which may be introduced to the greater boiling point fraction stream 106.

Steam 125 may be combined with the lesser boiling point fraction stream 108 upstream of the cracking of the lesser boiling point fraction stream 108. Steam 125 may act as a diluent to reduce a partial pressure of the hydrocarbons in the lesser boiling point fraction stream 108. The steam:oil mass ratio of the combined mixture of steam 125 and stream 108 may be 0.2-0.8. As described herein, the oil of the steam:oil ratio refers to all hydrocarbons in the stream, and the steam in the steam:oil ratio refers to all $H_2O$ in the steam. In additional embodiments, the steam:oil ratio may be from 0.2 to 0.25, from 0.25 to 0.3, from 0.3 to 0.35, from 0.35 to 0.4, from 0.4 to 0.45, from 0.45 to 0.5, from 0.5 to 0.55, from 0.55 to 0.6, from 0.6 to 0.65, from 0.65 to 0.7, from 0.7 to 0.75, from 0.75 to 0.8, or any combination of these ranges.

Steam 129 may be combined with the greater boiling point fraction stream 106 upstream of the cracking of the greater boiling point fraction stream 106. Steam 129 may act as a diluent to reduce a partial pressure of the hydrocarbons in the greater boiling point fraction stream 106. The steam:oil mass ratio of the combined mixture of steam 129 and stream 106 may be at least 0.5. In additional embodiments, the steam:oil ratio may be from 0.5 to 0.55, from 0.55 to 0.6, from 0.6 to 0.65, from 0.65 to 0.7, from 0.7 to 0.75, from 0.75 to 0.8, from 0.8 to 0.85, from 0.85 to 0.9, from 0.9 to 0.95, or any combination of these ranges.

Steam 125 and/or steam 129 may serve the purpose of lowering hydrocarbon partial pressure, which may have the dual effects of increasing yields of light olefins (e.g., ethylene, propylene and butylene) as well as reducing coke formation. Light olefins like propylene and butylene are mainly generated from catalytic cracking reactions following the carbonium ion mechanism, and as these are intermediate products, they can undergo secondary reactions such as hydrogen transfer and aromatization (leading to coke formation). Steam 125 and/or steam 129 may increase the yield of light olefins by suppressing these secondary bimolecular reactions, and reduce the concentration of reactants and products which favor selectivity towards light olefins. The steam 125 and/or 129 may also suppress secondary reactions that are responsible for coke formation on a catalyst surface, which is good for catalysts to maintain high average activation. These factors may show that a large steam-to-oil weight ratio is beneficial to the production of light olefins. However, the steam-to-oil weight ratio may not be enhanced infinitely in the practical industrial operating process, since increasing the amount of steam 125 and/or steam 129 will result in the increase of the whole energy consumption, the decrease of disposal capacity of unit equipment, and the inconvenience of succeeding condensation and separation of products. Therefore, the optimum steam:oil ratio may be a function of other operating parameters.

The amount of steam 125 introduced to the greater boiling point fraction stream 106 may be greater than the amount of steam 129 introduced to the lesser boiling point fraction stream 108 (based on the relative mass flowrate of the greater boiling point fraction stream 106 and the lesser boiling point faction stream 108, respectively). That is, in one or more embodiments, the steam:oil mass ratio of the combined mixture of steam 129 and stream 106 may be greater than the steam:oil mass ratio of the combined mixture of steam 125 and stream 108. The greater boiling point fraction stream 106 may generally contain more polyaromatics, which are coke precursors, than the lesser boiling point fraction stream 108. Without being bound by theory, it is believed that introducing relatively more steam 125 to the greater boiling point fraction stream 106 may help suppress secondary reactions that are responsible for coke formation on a catalyst surface, which is good for catalysts to maintain high average activation. However, without the concern of high concentrations of these polyaromatics, the lesser boiling point fraction stream 108 may include a lesser oil:stream ratio, which may contribute to advantages such as the decrease of the whole energy consumption, the increase of disposal capacity of unit equipment, and the lack of inconvenience of succeeding condensation and separation of products.

In some embodiments, steam 125 and/or steam 129 may also be used to preheat the greater boiling point fraction stream 106 and/or lesser boiling point fraction stream 108 with steam 125, respectively, Before the greater boiling point fraction stream 106 and/or lesser boiling point fraction stream 108 enter their respective reactors, the temperatures of the greater boiling point fraction stream 106 and/or lesser boiling point fraction stream 108 may be increased by mixing with the steam 125 and/or steam 129. However, it should be understood that the temperature of the mixed steam and oil streams may be less than or equal to 250° C. Temperatures greater than 250° C. may cause fouling caused by cracking of the hydrocarbon feed stream 102. Fouling may lead to blockage of the reactor inlet. The reaction temperature (such as greater than 500° C.) may be achieved by using hot catalyst from the regeneration and/or fuel burners. That is, the steam 125 and/or 129 may be insufficient to heat the reactant streams to reaction temperatures, and may be ineffective in increasing the temperature by providing additional heating to the mixture at temperatures present inside of the reactors (e.g., greater than 500° C.). In general, the steam described herein in steams 125 and/or 129 is not utilized to increase temperature within the reactor, but rather to dilute the oils and reduce oil partial pressure in the reactor. Instead, the mixing of steam and oil may be sufficient to vaporize the oils at a temperature of less than 250° C. to avoid fouling.

The greater boiling point fraction stream 106 (which now includes steam 129) may be passed to a first FCC unit 120 that includes a first cracking reaction zone 122. The greater boiling point fraction stream 106 may be added to the first catalyst/feed mixing zone 136. The greater boiling point fraction stream 106 may be combined or mixed with a first catalyst 124 and cracked to produce a mixture of a spent first catalyst 126 and a first cracking reaction product stream 128. At least a portion of the greater boiling point fraction stream 106 may be cracked in the presence of steam 129 to produce the first cracking reaction product stream 128. The spent first catalyst 126 may be separated from the first cracking reaction product stream 128 and passed to a regeneration zone 162 of the regenerator 160.

The lesser boiling point fraction stream 108 (which now includes steam 125) may be passed to a second FCC unit 140 that includes a second cracking reaction zone 142. The lesser boiling point fraction stream 108 may be added to the second catalyst/feed mixing zone 156. The lesser boiling point fraction stream 108 may be mixed with a second catalyst 144 and cracked to produce a spent second catalyst 146 and a second cracking reaction product stream 148. At least a portion of the lesser boiling point fraction stream 108 may be cracked in the presence of steam 125 to produce the second cracking reaction product stream 148. The spent second catalyst 146 may be separated from the second cracking reaction product stream 148 and passed to the regeneration zone 162 of the regenerator 160. The spent first catalyst 126 and the spent second catalyst 146 may be combined and regenerated in the regeneration zone 162 of the regenerator 160 to produce a regenerated catalyst 116. The regenerated catalyst 116 may have a catalytic activity that is at least greater than the catalytic activity of the spent first catalyst 126 and the spent second catalyst 146. The regenerated catalyst 116 may then be passed back to the first cracking reaction zone 122 and the second cracking reaction zone 142. The first cracking reaction zone 122 and the second cracking reaction zone 142 may be operated in parallel.

It should be understood that, in some embodiments, the first catalyst 124 is different in composition than the second catalyst 144, and the first catalyst 124 and the second catalyst 144 may be regenerated in separate regeneration units. That is, in some embodiments, two regeneration units may be utilized. In other embodiments, such as where the first catalyst 124 and the second catalyst 144 are the same in composition, the first catalyst 124 and second catalyst 144 may be regenerated in a common regeneration zone 162 as depicted in FIG. 3.

The first cracking reaction product stream 128 and the second cracking reaction product stream 148 each may include a mixture of cracked hydrocarbon materials, which may be further separated into one or more greater value petrochemical products and recovered from the system in the one or more system product streams 110. For example, the first cracking reaction product stream 128, the second cracking reaction product stream 148, or both, may include one or more of cracked gas oil, cracked gasoline, cracked naphtha, mixed butenes, butadiene, propene, ethylene, other olefins, ethane, methane, other petrochemical products, or combinations of these. The cracked gasoline may be further processed to obtain aromatics such as benzene, toluene, xylenes, or other aromatics for example. The hydrocarbon feed conversion system 100 may include a product separator 112. The first cracking reaction product stream 128, the second cracking reaction product stream 148, or both the first and second cracking reaction product streams 128, 148, may be introduced to the product separator 112 to separate these streams into a plurality of system product streams 110 (represented by a single arrow but possibly including two or more streams), cycle oil streams 111, or both system product streams 110 and cycle oil streams 111. In some embodiments, the first cracking reaction product stream 128 and the second cracking reaction product stream 148 may be combined into a combined cracking reaction product stream 114. The combined cracking reaction product stream 114 may be introduced to the product separator 112. Referring to FIGS. 2 and 3, the product separator 112 may be fluidly coupled to the first separation zone 130, the second separation zone 150, or both the first separation zone 130 and the second separation zone 150. In embodiments, the first stripped product stream 134 and the second stripped product stream 154 may be combined to form mixed stripped product stream 171. The mixed stripped product stream 171 may be combined into the steam 127 comprising steam.

Referring to FIG. 2, the product separator 112 may be a distillation column or collection of separation devices that separates the first cracking reaction product stream 128, the second cracking reaction product stream 148, or the combined cracking reaction product stream 114, into one or more system product streams 110, which may include one or more fuel oil streams, gasoline streams, mixed butenes stream, butadiene stream, propene stream, ethylene stream, ethane stream, methane stream, light cycle oil streams (LCO, 216-343° C.), heavy cycle oil streams (HCO, >343° C.), other product streams, or combinations of these. Each system product stream 110 may be passed to one or more additional unit operations for further processing, or may be sold as raw goods. In embodiments, the first cracking reaction product stream 128 and the second cracking reaction product stream 148 may be separately introduced to the product separator 112. As used in this disclosure, the one or more system product streams 110 may be referred to as petrochemical products, which may be used as intermediates in downstream chemical processing or packaged as finished products. The product separator 112 may also produce one or more cycle oil streams 111, which may be hydrotreated in the hydrotreating unit 113 and recycled to the hydrocarbon feed conversion system 100.

Generally, the cycle oil stream 111 may include the heaviest portions of the combined cracking reaction product stream 114. In one or more embodiments, at least 99 wt. % of the cycle oil stream 111 may have boiling points of at least 215° C. In some embodiments, the cycle oil stream 111 may be the fraction from the distillation of a catalytic cracking product, which may boil in the range of from 215 to 371° C.

Still referring to FIG. 2, the cycle oil stream 111 may exit the product separator 112 and be introduced the hydrotreating unit 113. The cycle oil stream 111 may be hydrotreated to form a hydrotreated cycle oil stream 115. It should be understood that, while several specific embodiments of hydroprocessing catalysts are disclosed herein, the hydroprocessing catalysts and conditions are not necessarily limited in the embodiments presently described.

Hydrotreating cycle oil stream 111 may occur under conditions that substantially saturate the aromatic species, such that species like naphthalenes are converted to single ring aromatic species. The hydrotreated cycle oil stream 115 may have a greater propensity for cracking to light olefins (C2-C4). The hydrotreating process may convert unsaturated hydrocarbons, such as olefins and diolefins, to paraffins, which may easily be cracked to light olefins. Heteroatoms and contaminant species may also be removed by the hydrotreating process. These species may include sulfur, nitrogen, oxygen, halides, and certain metals.

The hydrotreating process may remove sulfur along with metal contaminants, nitrogen, which will help prolonging catalyst activity and reduce Nitrogen Oxide ($NO_x$) emissions during catalyst regeneration. The hydrotreating process may reduce the amount of polyaromatics which are coke precursors. Feeds with high aromatic content also may act as coke precursors and usually have the tendency to produce more coke during catalytic cracking. The hydrotreating process may convert polyaromatics to single ring aromatics for easy cracking to light olefins. The hydrotreating process may maximize light olefins yield.

The hydrotreating unit 113 may improve the hydrogen content and cracking ability of the cycle oil stream 111. The hydrotreating process may remove one or more of at least a portion of nitrogen, sulfur, and one or more metals from the cycle oil stream 111, and may additionally break aromatic moieties in the cycle oil stream 111. According to one or more embodiments, the contents of the cycle oil stream 111 entering the hydrotreating unit 113 may have a relatively large amount of one or more of metals (for example, Vanadium, Nickel, or both), sulfur, and nitrogen. For example, the contents of the cycle oil stream 111 entering the hydrotreating unit 113 may comprise one or more of greater than 17 parts per million by weight of metals, greater than 135 parts per million by weight of sulfur, and greater than 50 parts per million by weight of nitrogen. The contents of the hydrotreated cycle oil stream 115 exiting the hydrotreating unit 113 may have a relatively small amount of one or more of metals (for example, Vanadium, Nickel, or both), sulfur, and nitrogen. For example, the contents of the hydrotreated cycle oil stream 115 exiting the hydrotreating unit 113 may comprise one or more of 17 parts per million by weight of metals or less, 135 parts per million by weight of sulfur or less, and 50 parts per million by weight of nitrogen or less.

The cycle oil stream 111 may be treated with a hydrodemetalization catalyst (referred to sometimes in this disclosure as an "HDM catalyst"), a transition catalyst, a hydrodenitrogenation catalyst (referred to sometimes in this disclosure as an "HDN catalyst"), and a hydrocracking catalyst. The HDM catalyst, transition catalyst, HDN catalyst, and hydrocracking catalyst may be positioned in series, either contained in a single reactor, such as a packed bed reactor with multiple beds, or contained in two or more reactors arranged in series.

The hydrotreating unit 113 may include multiple catalyst beds arranged in series. For example, the hydrotreating unit 113 may comprise one or more of an HDM reaction zone, a transition reaction zone, a HDN reaction zone, and a hydrocracking reaction zone. The hydrotreating unit 113 may comprise an HDM catalyst bed comprising an HDM catalyst in the HDM reaction zone, a transition catalyst bed comprising a transition catalyst in the transition reaction zone, an HDN catalyst bed comprising an HDN catalyst in the HDN reaction zone, and a hydrocracking catalyst bed comprising a hydrocracking catalyst in the hydrocracking reaction zone.

According to one or more embodiments, the cycle oil stream 111 may be introduced to the HDM reaction zone and be contacted by the HDM catalyst. Contact by the HDM catalyst with the cycle oil stream 111 may remove at least a portion of the metals present in the cycle oil stream 111. Following contact with the HDM catalyst, the cycle oil stream 111 may be converted to an HDM reaction effluent. The HDM reaction effluent may have a reduced metal content as compared to the contents of the cycle oil stream 111. For example, the HDM reaction effluent may have at least 70 wt. % less, at least 80 wt. % less, or even at least 90 wt. % less metal as the cycle oil stream 111.

According to one or more embodiments, the HDM reaction zone may have a weighted average bed temperature of from 350° C. to 450° C., such as from 370° C. to 415° C., and may have a pressure of from 30 bars to 200 bars, such as from 90 bars to 110 bars. The HDM reaction zone comprises the HDM catalyst, and the HDM catalyst may fill the entirety of the HDM reaction zone.

The HDM catalyst may comprise one or more metals from the International Union of Pure and Applied Chemistry (IUPAC) Groups 5, 6, or 8-10 of the periodic table. For example, the HDM catalyst may comprise molybdenum. The HDM catalyst may further comprise a support material, and the metal may be disposed on the support material. In one embodiment, the HDM catalyst may comprise a molybdenum metal catalyst on an alumina support (sometimes referred to as "$Mo/Al_2O_3$ catalyst"). It should be understood throughout this disclosure that metals that are contained in any of the disclosed catalysts may be present as sulfides or oxides, or even other compounds.

In one embodiment, the HDM catalyst may include a metal sulfide on a support material, where the metal is selected from the group consisting of IUPAC Groups 5, 6, and 8-10 elements of the periodic table, and combinations thereof. The support material may be gamma-alumina or silica/alumina extrudates, spheres, cylinders, beads, pellets, and combinations thereof.

In one embodiment, the HDM catalyst may comprise a gamma-alumina support, with a surface area of from 100 $m^2/g$ to 160 $m^2/g$ (such as, from 100 $m^2/g$ to 130 $m^2/g$, or from 130 $m^2/g$ to 160 $m^2/g$). The HDM catalyst can be best described as having a relatively large pore volume, such as at least 0.8 $cm^3/g$ (for example, at least 0.9 $cm^3/g$, or even at least 1.0 $cm^3/g$. The pore size of the HDM catalyst may be predominantly macroporous (that is, having a pore size of greater than 50 nm). This may provide a large capacity for the uptake of metals on the HDM catalyst's surface and optionally dopants. In one embodiment, a dopant can be selected from the group consisting of boron, silicon, halogens, phosphorus, and combinations thereof.

In one or more embodiments, the HDM catalyst may comprise from 0.5 wt. % to 12 wt. % of an oxide or sulfide of molybdenum (such as from 2 wt. % to 10 wt. % or from 3 wt. % to 7 wt. % of an oxide or sulfide of molybdenum), and from 88 wt. % to 99.5 wt. % of alumina (such as from 90 wt. % to 98 wt. % or from 93 wt. % to 97 wt. % of alumina).

Without being bound by theory, in some embodiments, it is believed that during the reaction in the HDM reaction zone, porphyrin type compounds present in the cycle oil are first hydrogenated by the catalyst using hydrogen to create an intermediate. Following this primary hydrogenation, the nickel or vanadium present in the center of the porphyrin molecule may be reduced with hydrogen and then further reduced to the corresponding sulfide with hydrogen sulfide ($H_2S$). The final metal sulfide may be deposited on the catalyst thus removing the metal sulfide from the cycle oil stream 111. Sulfur may be also removed from sulfur containing organic compounds. This may be performed through a parallel pathway. The rates of these parallel reactions may depend upon the sulfur species being considered. Overall, hydrogen may be used to abstract the sulfur which is converted to $H_2S$ in the process. The remaining, sulfur-free hydrocarbon fragment may remain in the cycle oil stream 111.

The HDM reaction effluent may be passed from the HDM reaction zone to the transition reaction zone where it is contacted by the transition catalyst. Contact by the transition catalyst with the HDM reaction effluent may remove at least a portion of the metals present in the HDM reaction effluent stream as well as may remove at least a portion of the nitrogen present in the HDM reaction effluent stream. Following contact with the transition catalyst, the HDM reaction effluent may be converted to a transition reaction effluent. The transition reaction effluent may have a reduced metal content and nitrogen content as compared to the HDM reaction effluent. For example, the transition reaction effluent may have at least 1 wt. % less, at least 3 wt. % less, or even at least 5 wt. % less metal content as the HDM reaction effluent. Additionally, the transition reaction effluent may have at least 10 wt. % less, at least 15 wt. % less, or even at least 20 wt. % less nitrogen as the HDM reaction effluent.

According to embodiments, the transition reaction zone may have a weighted average bed temperature of about 370° C. to 410° C. The transition reaction zone may comprise the transition catalyst, and the transition catalyst may fill the entirety of the transition reaction zone.

In one embodiment, the transition reaction zone may be operable to remove a quantity of metal components and a quantity of sulfur components from the HDM reaction effluent stream. The transition catalyst may comprise an alumina based support in the form of extrudates.

In one embodiment, the transition catalyst may comprise one metal from IUPAC Group 6 and one metal from IUPAC Groups 8-10. Example IUPAC Group 6 metals include molybdenum and tungsten. Example IUPAC Group 8-10 metals include nickel and cobalt. For example, the transition catalyst may comprise Mo and Ni on a titania support (sometimes referred to as "$Mo—Ni/Al_2O_3$ catalyst"). The transition catalyst may also contain a dopant that is selected from the group consisting of boron, phosphorus, halogens, silicon, and combinations thereof. The transition catalyst can have a surface area of 140 $m^2/g$ to 200 $m^2/g$ (such as from 140 $m^2/g$ to 170 $m^2/g$ or from 170 $m^2/g$ to 200 $m^2/g$). The transition catalyst can have an intermediate pore volume of from 0.5 $cm^3/g$ to 0.7 $cm^3/g$ (such as 0.6 $cm^3/g$). The transition catalyst may generally comprise a mesoporous structure having pore sizes in the range of 12 nm to 50 nm. These characteristics provide a balanced activity in HDM and HDS.

In one or more embodiments, the transition catalyst may comprise from 10 wt. % to 18 wt. % of an oxide or sulfide of molybdenum (such as from 11 wt. % to 17 wt. % or from 12 wt. % to 16 wt. % of an oxide or sulfide of molybdenum), from 1 wt. % to 7 wt. % of an oxide or sulfide of nickel (such as from 2 wt. % to 6 wt. % or from 3 wt. % to 5 wt. % of an oxide or sulfide of nickel), and from 75 wt. % to 89 wt. % of alumina (such as from 77 wt. % to 87 wt. % or from 79 wt. % to 85 wt. % of alumina).

The transition reaction effluent may be passed from the transition reaction zone to the HDN reaction zone where it is contacted by the HDN catalyst. Contact by the HDN catalyst with the transition reaction effluent may remove at least a portion of the nitrogen present in the transition reaction effluent stream. Following contact with the HDN catalyst, the transition reaction effluent may be converted to an HDN reaction effluent. The HDN reaction effluent may have a reduced metal content and nitrogen content as compared to the transition reaction effluent. For example, the HDN reaction effluent may have a nitrogen content reduction of at least 80 wt. %, at least 85 wt. %, or even at least 90 wt. % relative to the transition reaction effluent. In another embodiment, the HDN reaction effluent may have a sulfur content reduction of at least 80 wt. %, at least 90 wt. %, or even at least 95 wt. % relative to the transition reaction effluent. In another embodiment, the HDN reaction effluent may have an aromatics content reduction of at least 25 wt. %, at least 30 wt. %, or even at least 40 wt. % relative to the transition reaction effluent.

According to embodiments, the HDN reaction zone may have a weighted average bed temperature of from 370° C. to 410° C. The HDN reaction zone comprises the HDN catalyst, and the HDN catalyst may fill the entirety of the HDN reaction zone.

In one embodiment, the HDN catalyst may include a metal oxide or sulfide on a support material, where the metal is selected from the group consisting of IUPAC Groups 5, 6, and 8-10 of the periodic table, and combinations thereof. The support material may include gamma-alumina, mesoporous alumina, silica, or both, in the form of extrudates, spheres, cylinders and pellets.

According to one embodiment, the HDN catalyst may contain a gamma alumina based support that has a surface area of 180 $m^2/g$ to 240 $m^2/g$ (such as from 180 $m^2/g$ to 210 $m^2/g$, or from 210 $m^2/g$ to 240 $m^2/g$). This relatively large surface area for the HDN catalyst may allow for a smaller pore volume (for example, less than 1.0 $cm^3/g$, less than 0.95 $cm^3/g$, or even less than 0.9 $cm^3/g$). In one embodiment, the HDN catalyst may contain at least one metal from IUPAC Group 6, such as molybdenum and at least one metal from IUPAC Groups 8-10, such as nickel. The HDN catalyst can also include at least one dopant selected from the group consisting of boron, phosphorus, silicon, halogens, and combinations thereof. In one embodiment, cobalt can be used to increase desulfurization of the HDN catalyst. In one embodiment, the HDN catalyst may have a higher metals loading for the active phase as compared to the HDM catalyst. This increased metals loading may cause increased catalytic activity. In one embodiment, the HDN catalyst may comprise nickel and molybdenum, and has a nickel to molybdenum mole ratio (Ni/(Ni+Mo)) of 0.1 to 0.3 (such as from 0.1 to 0.2 or from 0.2 to 0.3). In an embodiment that includes cobalt, the mole ratio of (Co+Ni)/Mo may be in the range of 0.25 to 0.85 (such as from 0.25 to 0.5 or from 0.5 to 0.85).

According to another embodiment, the HDN catalyst may contain a mesoporous material, such as mesoporous alumina, that may have an average pore size of at least 25 nm. For example, the HDN catalyst may comprise mesoporous alumina having an average pore size of at least 30 nm, or even at least 35 nm. HDN catalysts with relatively small average pore size, such as less than 25 nm, may be referred to as conventional HDN catalysts in this disclosure, and may have relatively poor catalytic performance as compared with the larger pore-sized HDN catalysts presently disclosed. Embodiments of HDN catalysts which have an alumina support having an average pore size of from 2 nm to 50 nm may be referred to in this disclosure as "meso-porous alumina supported catalysts." In one or more embodiments, the mesoporous alumina of the HDM catalyst may have an average pore size in a range from 25 nm to 50 nm, from 30 nm to 50 nm, or from 35 nm to 50 nm. According to embodiments, the HDN catalyst may include alumina that has a relatively large surface area, a relatively large pore volume, or both. For example, the mesoporous alumina may have a relatively large surface area by having a surface area of at least about 225 $m^2/g$, at least about 250 $m^2/g$, at least about 275 $m^2/g$, at least about 300 $m^2/g$, or even at least about 350 $m^2/g$, such as from 225 $m^2/g$ to 500 $m^2/g$, from 200 $m^2/g$ to 450 $m^2/g$, or from 300 $m^2/g$ to 400 $m^2/g$. In one or more embodiments, the mesoporous alumina may have a relatively large pore volume by having a pore volume of at least about 1 mL/g, at least about 1.1 mL/g, at least 1.2 mL/g, or even at least 1.2 mL/g, such as from 1 mL/g to 5 mL/g, from 1.1 mL/g to 3, or from 1.2 mL/g to 2 mL/g. Without being bound by theory, it is believed that the meso-porous alumina supported HDN catalyst may provide additional active sites and a larger pore channels that may facilitate larger molecules to be transferred into and out of the catalyst. The additional active sites and larger pore channels may result in higher catalytic activity, longer catalyst life, or both. In one embodiment, a dopant can be selected from the group consisting of boron, silicon, halogens, phosphorus, and combinations thereof.

According to embodiments described, the HDN catalyst may be produced by mixing a support material, such as alumina, with a binder, such as acid peptized alumina. Water or another solvent may be added to the mixture of support material and binder to form an extrudable phase, which is then extruded into a desired shape. The extrudate may be dried at an elevated temperature (such as above 100° C., such as 110° C.) and then calcined at a suitable temperature (such as at a temperature of at least 400° C., at least 450° C., such as 500° C.). The calcined extrudates may be impregnated with an aqueous solution containing catalyst precursor materials, such as precursor materials which include Mo, Ni, or combinations thereof. For example, the aqueous solution may contain ammonium heptanmolybdate, nickel nitrate, and phosphoric acid to form an HDN catalyst comprising compounds comprising molybdenum, nickel, and phosphorous.

In embodiments where a mesoporous alumina support is utilized, the mesoporous alumina may be synthesized by dispersing boehmite powder in water at 60° C. to 90° C. Then, an acid such as $HNO_3$ may be added to the boehmite water solution at a ratio of $HNO_3$:$Al_3^+$ of 0.3 to 3.0 and the solution may be stirred at 60° C. to 90° C. for several hours, such as 6 hours, to obtain a sol. A copolymer, such as a triblock copolymer, may be added to the sol at room temperature, where the molar ratio of copolymer:Al is from 0.02 to 0.05 and aged for several hours, such as three hours. The sol/copolymer mixture may be dried for several hours and then calcined.

According to one or more embodiments, the HDN catalyst may comprise from 10 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 74 wt. % to 88 wt. % of alumina (such as from 76 wt. % to 84 wt. % or from 78 wt. % to 82 wt. % of alumina).

In a similar manner to the HDM catalyst, and again not intending to be bound to any theory, it is believed that hydrodenitrogenation and hydrodearomatization may operate via related reaction mechanisms. Both may involve some degree of hydrogenation. For the hydrodenitrogenation, organic nitrogen compounds are usually in the form of heterocyclic structures, the heteroatom being nitrogen. These heterocyclic structures may be saturated prior to the removal of the heteroatom of nitrogen. Similarly, hydrodearomatization may involve the saturation of aromatic rings. Each of these reactions may occur to a differing amount on each of the catalyst types as the catalysts are selective to favor one type of transfer over others and as the transfers are competing.

It should be understood that some embodiments of the presently described methods and systems may utilize HDN catalyst that include porous alumina having an average pore size of at least 25 nm. However, in other embodiments, the average pore size of the porous alumina may be less than about 25 nm, and may even be microporous (that is, having an average pore size of less than 2 nm).

Still referring to FIG. 2, the HDN reaction effluent may be passed from the HDN reaction zone to the hydrocracking reaction zone where it is contacted by the hydrocracking catalyst. Contact by the hydrocracking catalyst with the HDN reaction effluent may reduce aromatic content present in the HDN reaction effluent. Following contact with the hydrocracking catalyst, the HDN reaction effluent may be converted to the hydrotreated cycle oil stream 115. The hydrotreated cycle oil stream 115 may have reduced aromatics content as compared to the HDN reaction effluent. For example, the hydrotreated cycle oil stream 115 may have at least 50 wt. % less, at least 60 wt. % less, or even at least 80 wt. % less aromatics content as the HDN reaction effluent.

The hydrocracking catalyst may comprise one or more metals from IUPAC Groups 5, 6, 8, 9, or 10 of the periodic table. For example, the hydrocracking catalyst may comprise one or more metals from IUPAC Groups 5 or 6, and one or more metals from IUPAC Groups 8, 9, or 10 of the periodic table. For example, the hydrocracking catalyst may comprise molybdenum or tungsten from IUPAC Group 6 and nickel or cobalt from IUPAC Groups 8, 9, or 10. The HDM catalyst may further comprise a support material, and the metal may be disposed on the support material, such as a zeolite. In one embodiment, the hydrocracking catalyst may comprise tungsten and nickel metal catalyst on a zeolite support that is mesoporous (sometimes referred to as "W—Ni/meso-zeolite catalyst"). In another embodiment, the hydrocracking catalyst may comprise molybdenum and nickel metal catalyst on a zeolite support that is mesoporous (sometimes referred to as "Mo—Ni/meso-zeolite catalyst").

According to some embodiments of the hydrocracking catalysts of the catalytic systems described in this disclosure, the support material (that is, the mesoporous zeolite) may be characterized as mesoporous by having an average pore size of from 2 nm to 50 nm. Without being bound by theory, it is believed that the relatively large pore size (that is, mesoporosity) of the presently described hydrocracking catalysts allows for larger molecules to diffuse inside the zeolite, which is believed to enhance the reaction activity and selectivity of the catalyst. With the increased pore size, aromatic containing molecules can more easily diffuse into the catalyst and aromatic cracking may be increased. For example, zeolites with larger pore sizes (that is, mesoporous zeolites) may make the larger molecules of cycle oil stream 111 overcome the diffusion limitation, and may make possible reaction and conversion of the larger molecules of the cycle oil stream 111.

The zeolite support material is not necessarily limited to a particular type of zeolite. However, it is contemplated that zeolites such as Y, Beta, AWLZ-15, LZ-45, Y-82, Y-84, LZ-210, LZ-25, Silicalite, or mordenite may be suitable for use in the presently described hydrocracking catalyst. For example, suitable mesoporous zeolites which can be impregnated with one or more catalytic metals such as W, Ni, Mo, or combinations thereof, are described in at least U.S. Pat. No. 7,785,563; Zhang et al., Powder Technology 183 (2008) 73-78; Liu et al., Microporous and Mesoporous Materials 181 (2013) 116-122; and Garcia-Martinez et al., Catalysis Science & Technology, 2012 (DOI: 10.1039/c2cy00309k).

In one or more embodiments, the hydrocracking catalyst may comprise from 18 wt. % to 28 wt. % of a sulfide or oxide of tungsten (such as from 20 wt. % to 27 wt. % or from 22 wt. % to 26 wt. % of tungsten or a sulfide or oxide of tungsten), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of zeolite). In another embodiment, the hydrocracking catalyst may comprise from 12 wt. % to 18 wt. % of an oxide or sulfide of molybdenum (such as from 13 wt. % to 17 wt. % or from 14 wt. % to 16 wt. % of an oxide or sulfide of molybdenum), from 2 wt. % to 8 wt. % of an oxide or sulfide of nickel (such as from 3 wt. % to 7 wt. % or from 4 wt. % to 6 wt. % of an oxide or sulfide of nickel), and from 5 wt. % to 40 wt. % of mesoporous zeolite (such as from 10 wt. % to 35 wt. % or from 10 wt. % to 30 wt. % of mesoporous zeolite).

The embodiments of the hydrocracking catalysts described may be fabricated by selecting a mesoporous zeolite and impregnating the mesoporous zeolite with one or more catalytic metals or by comulling mesoporous zeolite with other components. For the impregnation method, the mesoporous zeolite, active alumina (for example, boehmite alumina), and binder (for example, acid peptized alumina) may be mixed. An appropriate amount of water may be added to form a dough that can be extruded using an extruder. The extrudate may be dried at 80° C. to 120° C. for 4 hours to 10 hours, and then calcinated at 500° C. to 550° C. for 4 hours to 6 hours. The calcinated extrudate may be impregnated with an aqueous solution prepared by the compounds comprising Ni, W, Mo, Co, or combinations thereof. Two or more metal catalyst precursors may be utilized when two metal catalysts are desired. However, some embodiments may include only one of Ni, W, Mo, or Co. For example, the catalyst support material may be impregnated by a mixture of nickel nitrate hexahydrate (that is, $Ni(NO_3)_2.6H_2O$) and ammonium metatungstate (that is, $(NH_4)_6H_2W_{12}O_{40}$) if a W—Ni catalyst is desired. The impregnated extrudate may be dried at 80° C. to 120° C. for 4 hours to 10 hours, and then calcinated at 450° C. to 500° C. for 4 hours to 6 hours. For the comulling method, the mesoporous zeolite may be mixed with alumina, binder, and the compounds comprising W or Mo, Ni or Co (for example $MoO_3$ or nickel nitrate hexahydrate if Mo—Ni is desired).

It should be understood that some embodiments of the presently described methods and systems may utilize a hydrocracking catalyst that includes a mesoporous zeolite (that is, having an average pore size of from 2 nm to 50 nm). However, in other embodiments, the average pore size of the zeolite may be less than 2 nm (that is, microporous).

According to one or more embodiments described, the volumetric ratio of HDM catalyst:transition catalyst:HDN catalyst:hydrocracking catalyst may be 5-20:5-30:30-70:5-30 (such as a volumetric ratio of 5-15:5-15:50-60:15-20, or approximately 10:10:60:20.) The ratio of catalysts may depend at least partially on the metal content in the oil feedstock processed.

The hydrotreated cycle oil stream 115 may be combined with the lesser boiling point fraction stream 108, the greater boiling point fraction stream 106, the hydrocarbon feed stream 102, or combinations thereof. For example, the hydrotreated cycle oil stream 115 may be combined with the lesser boiling point fraction stream 108 upstream of the cracking of the lesser boiling point fraction stream 108. In such embodiments, the hydrotreated cycle oil stream 115 may not be recycled back to the first FCC unit 120. In another embodiment, the hydrotreated cycle oil stream 115 may be combined with the greater boiling point fraction stream 106 upstream of the cracking of the greater boiling point fraction stream 106 (as shown in FIG. 2). In such embodiments, the hydrotreated cycle oil stream 115 may not be recycled back to the second FCC unit 140. In another embodiment, the hydrotreated cycle oil stream 115 may be combined with the hydrocarbon feed stream 102. For example, the cycle oil stream may be passed into the feed separator 104. In general, the composition of the hydrotreated cycle oil stream 115 and the utilized cut point in the feed separator may determine to where the cycle oil stream is recycled.

As depicted in FIG. 2, the hydrotreated cycle oil stream 115 may exit the hydrotreating unit 113 and be recycled back into the hydrocarbon feed conversion system 100. The hydrotreated cycle oil stream 115 may be combined with the greater boiling point fraction stream 106. The combined stream may be introduced to the first FCC unit 120. The hydrotreated cycle oil stream 115 may not be recycled back to the second FCC unit 140. The ratio of the greater boiling point fraction stream 106 to the hydrotreated cycle oil stream 115 may be at least 0.05. In some embodiments, the ratio of the greater boiling point fraction stream 106 to the hydrotreated cycle oil stream 115 may be from 0.05 to 0.2. In some embodiments, the ratio of the greater boiling point fraction stream 106 to the hydrotreated cycle oil stream 115 may be 0.1.

Referring now to FIG. 3, the first FCC unit 120 may include a first catalyst/feed mixing zone 136, the first cracking reaction zone 122, a first separation zone 130, and a first stripping zone 132. The greater boiling point fraction stream 106 may be introduced to the first catalyst/feed mixing zone 136, where the greater boiling point fraction stream 106 may be mixed with the first catalyst 124. During steady state operation of the hydrocarbon feed conversion system 100, the first catalyst 124 may include at least the regenerated catalyst 116 that is passed to the first catalyst/feed mixing zone 136 from a catalyst hopper 174. In embodiments, the first catalyst 124 may be a mixture of spent first catalyst 126 and regenerated catalyst 116. Alternatively, the first catalyst 124 may be a mixture of spent second catalyst 146 and regenerated catalyst 116. The catalyst hopper 174 may receive the regenerated catalyst 116 from the regenerator 160. At initial start-up of the hydrocarbon feed conversion system 100, the first catalyst 124 may include fresh catalyst (not shown), which is catalyst that has not been circulated through the first FCC unit 120 or the second FCC unit 140 and the regenerator 160. Because the fresh catalyst has not been circulated through a cracking reaction zone, the fresh catalyst may have a catalytic activity that is greater than the regenerated catalyst 116. In embodiments, fresh catalyst may also be introduced to the catalyst hopper 174 during operation of the hydrocarbon feed conversion system 100 so that a portion of the first catalyst 124 introduced to the first catalyst/feed mixing zone 136 includes the fresh catalyst. Fresh catalyst may be introduced to the catalyst hopper 174 periodically during operation to replenish lost catalyst or compensate for spent catalyst that becomes deactivated, such as through heavy metal accumulation in the catalyst.

In some embodiments, one or more supplemental feed streams (not shown) may be combined with the greater boiling point fraction stream 106 before introduction of the greater boiling point fraction stream 106 to the first catalyst/feed mixing zone 136. In other embodiments, one or more supplemental feed streams may be added directly to the first catalyst/feed mixing zone 136, where the supplemental feed stream may be mixed with the greater boiling point fraction stream 106 and the first catalyst 124 prior to introduction into the first cracking reaction zone 122. As previously described, the supplemental feed stream may include one or more of vacuum residues, tar sands, bitumen, atmospheric residues, vacuum gas oils, demetalized oils, naphtha streams, other hydrocarbon streams, or combinations of these materials. Additionally, the hydrotreated cycle oil stream 115 from the product separator 112 (as shown in FIG. 2) may be combined with the greater boiling point fraction stream 106. For example, the hydrotreated cycle oil stream 115 may include a cycle oil or slurry oil recovered from the product separator 112.

The mixture comprising the greater boiling point fraction stream 106 and the first catalyst 124 may be passed from the first catalyst/feed mixing zone 136 to the first cracking reaction zone 122. The mixture of the greater boiling point fraction stream 106 and first catalyst 124 may be introduced to a top portion of the first cracking reaction zone 122. The first cracking reaction zone 122 may be a downflow reactor or "downer" reactor in which the reactants flow from the first catalyst/feed mixing zone 136 vertically downward through the first cracking reaction zone 122 to the first separation zone 130. The hydrotreated cycle oil stream 115 may be introduced to the greater boiling point fraction stream 106. Steam 129 may be introduced to the greater boiling point fraction stream 106. The greater boiling point fraction stream 106 may be reacted by contact with the first catalyst 124 in the first cracking reaction zone 122 to cause at least a portion of the greater boiling point fraction stream 106 to undergo at least a cracking reaction to form at least one cracking reaction product, which may include at least one of the petrochemical products previously described. The first catalyst 124 may have a temperature equal to or greater than the first cracking temperature $T_{122}$ of the first cracking reaction zone 122 and may transfer heat to the greater boiling point fraction stream 106 to promote the endothermic cracking reaction.

It should be understood that the first cracking reaction zone 122 of the first FCC unit 120 depicted in FIG. 3 is a simplified schematic of one particular embodiment of the first cracking reaction zone 122 of an FCC unit, and other configurations of the first cracking reaction zone 122 may be suitable for incorporation into the hydrocarbon feed conversion system 100. For example, in some embodiments, the first cracking reaction zone 122 may be an up-flow cracking reaction zone. Other cracking reaction zone configurations are contemplated. The first FCC unit may be a hydrocarbon feed conversion unit in which in the first cracking reaction zone 122, the fluidized first catalyst 124 contacts the greater boiling point fraction stream 106 under high-severity conditions. The first cracking temperature $T_{122}$ of the first cracking reaction zone 122 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In one or more embodiments, the first cracking temperature $T_{122}$ of the first cracking reaction zone 122 may be from 500° C. to 700° C. In one or more embodiments, the first cracking temperature $T_{122}$ of the first cracking reaction zone 122 may be from 550° C. to 630° C.

A weight ratio of the first catalyst 124 to the greater boiling point fraction stream 106 in the first cracking reaction zone 122 (the catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, or from 30:1 to 40:1. The residence time of the mixture of first catalyst 124 and the greater boiling point fraction stream 106 in the first cracking reaction zone 122 may be from 0.2 seconds (sec) to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec.

Following the cracking reaction in the first cracking reaction zone 122, the contents of the effluent from the first cracking reaction zone 122 may include the first catalyst 124 and the first cracking reaction product stream 128, which may then be passed to the first separation zone 130. In the first separation zone 130, the first catalyst 124 may be separated from at least a portion of the first cracking reaction product stream 128. In some embodiments, the first separation zone 130 may include one or more gas-solid separators, such as one or more cyclones. The first catalyst 124 exiting from the first separation zone 130 may retain at least a residual portion of the first cracking reaction product stream 128.

After the first separation zone 130, the first catalyst 124, which may include the residual portion of the first cracking reaction product stream 128 retained in the first catalyst 124, may be passed to a first stripping zone 132, where at least some of the residual portion of the first cracking reaction product stream 128 may be stripped from the first catalyst 124 and recovered as a first stripped product stream 134. The first stripped product stream 134 may be passed to one or more than one downstream unit operations or combined with one or more than one other streams for further processing. Steam 133 may be introduced to the first stripping zone 132 to facilitate stripping the first cracking reaction product stream 128 from the first catalyst 124. The first stripped product stream 134 may include at least a portion of the steam 133 introduced to the first stripping zone 132. The first stripped product stream 134 may be discharged from the first stripping zone 132 and may be passed through cyclone separators (not shown) and out of the stripper vessel (not shown). The first stripped product stream 134 may be directed to one or more product recovery systems in accordance with known methods in the art, or may be recycled by combining with steam 127. For example, the first stripped product stream 134, which may comprise a majority steam, may be combined with steam 127. In another embodiment, the first stripped product stream 134 may be separated into steam and hydrocarbons, and the steam portion may be combined with steam 127. The first stripped product stream 134 may also be combined with one or more other streams, such as the first cracking reaction product stream 128, for example. The spent first catalyst 126, which is the first catalyst 124 after stripping out the first stripped product stream 134, may be passed from the first stripping zone 132 to the regeneration zone 162 of the regenerator 160 to be regenerated to produce regenerated catalyst 116.

Referring still to FIG. 3, the lesser boiling point fraction stream 108 may be passed from the feed separator 104 to the second FCC unit 140 (as shown in FIG. 2). The second FCC unit 140 may include a second catalyst/feed mixing zone 156, the second cracking reaction zone 142, a second separation zone 150, and a second stripping zone 152. The lesser boiling point fraction stream 108 may be introduced to the second catalyst/feed mixing zone 156, where the lesser boiling point fraction stream 108 may be mixed with the second catalyst 144. During steady state operation of the hydrocarbon feed conversion system 100, the second catalyst 144 may include at least the regenerated catalyst 116 that is passed to the second catalyst/feed mixing zone 156 from a catalyst hopper 174. In embodiments, the second catalyst 144 may be a mixture of spent second catalyst 146 and regenerated catalyst 116. Alternatively, the second catalyst 144 may be a mixture of spent first catalyst 126 and regenerated catalyst 116. The catalyst hopper 174 may receive the regenerated catalyst 116 from the regenerator 160 following regeneration of the spent first catalyst 126 and spent second catalyst 146. At initial start-up of the hydrocarbon feed conversion system 100, the second catalyst 144 may include fresh catalyst (not shown), which is catalyst that has not been circulated through the first FCC unit 120 or the second FCC unit 140 and the regenerator 160. In embodiments, fresh catalyst may also be introduced to catalyst hopper 174 during operation of the hydrocarbon feed conversion system 100 so that at least a portion of the second catalyst 144 introduced to the second catalyst/feed mixing zone 156 includes the fresh catalyst. Fresh catalyst may be introduced to the catalyst hopper 174 periodically during operation to replenish lost catalyst or compensate for spent catalyst that becomes permanently deactivated, such as through heavy metal accumulation in the catalyst.

In some embodiments, one or more supplemental feed streams (not shown) may be combined with the lesser boiling point fraction stream 108 before introduction of the lesser boiling point fraction stream 108 to the second catalyst/feed mixing zone 156. In other embodiments, one or more supplemental feed streams may be added directly to the second catalyst/feed mixing zone 156, where the supplemental feed stream may be mixed with the lesser boiling point fraction stream 108 and the second catalyst 144 prior to introduction into the second cracking reaction zone 142. The supplemental feed stream may include one or more naphtha streams or other lesser boiling hydrocarbon streams.

The mixture comprising the lesser boiling point fraction stream 108 and the second catalyst 144 may be passed from the second catalyst/feed mixing zone 156 to the second cracking reaction zone 142. The mixture of the lesser boiling point fraction stream 108 and second catalyst 144 may be introduced to a top portion of the second cracking reaction zone 142. The second cracking reaction zone 142 may be a downflow reactor or "downer" reactor in which the reactants flow from the second catalyst/feed mixing zone 156 downward through the second cracking reaction zone 142 to the second separation zone 150. Steam 127 may be introduced to the top portion of the second cracking reaction zone 142 to provide additional heating to the mixture of the lesser boiling point fraction stream 108 and the second catalyst 144. The lesser boiling point fraction stream 108 may be reacted by contact with the second catalyst 144 in the second cracking reaction zone 142 to cause at least a portion of the lesser boiling point fraction stream 108 to undergo at least one cracking reaction to form at least one cracking reaction product, which may include at least one of the petrochemical products previously described. The second catalyst 144 may have a temperature equal to or greater than the second cracking temperature $T_{142}$ of the second cracking reaction zone 142 and may transfer heat to the lesser boiling point fraction stream 108 to promote the endothermic cracking reaction.

It should be understood that the second cracking reaction zone 142 of the second FCC unit 140 depicted in FIG. 3 is a simplified schematic of one particular embodiment of the second cracking reaction zone 142, and other configurations of the second cracking reaction zone 142 may be suitable for incorporation into the hydrocarbon feed conversion system 100. For example, in some embodiments, the second cracking reaction zone 142 may be an up-flow cracking reaction zone. Other cracking reaction zone configurations are contemplated. The second FCC unit may be a hydrocarbon feed conversion unit in which in the second cracking reaction zone 142, the fluidized second catalyst 144 contacts the lesser boiling point fraction stream 108 at high-severity conditions. The second cracking temperature $T_{142}$ of the second cracking reaction zone 142 may be from 500° C. to 800° C., from 500° C. to 700° C., from 500° C. to 650° C., from 500° C. to 600° C., from 550° C. to 800° C., from 550° C. to 700° C., from 550° C. to 650° C., from 550° C. to 600° C., from 600° C. to 800° C., from 600° C. to 700° C., or from 600° C. to 650° C. In some embodiments, the second cracking temperature $T_{142}$ of the second cracking reaction zone 142 may be from 500° C. to 700° C. In other embodiments, the second cracking temperature $T_{142}$ of the second cracking reaction zone 142 may be from 550° C. to 630° C. In some embodiments, the second cracking temperature $T_{142}$ may be different than the first cracking temperature $T_{122}$.

A weight ratio of the second catalyst 144 to the lesser boiling point fraction stream 108 in the second cracking reaction zone 142 (catalyst to hydrocarbon ratio) may be from 5:1 to 40:1, from 5:1 to 35:1, from 5:1 to 30:1, from 5:1 to 25:1, from 5:1 to 15:1, from 5:1 to 10:1, from 10:1 to 40:1, from 10:1 to 35:1, from 10:1 to 30:1, from 10:1 to 25:1, from 10:1 to 15:1, from 15:1 to 40:1, from 15:1 to 35:1, from 15:1 to 30:1, from 15:1 to 25:1, from 25:1 to 40:1, from 25:1 to 35:1, from 25:1 to 30:1, or from 30:1 to 40:1. In some embodiments, the weight ratio of the second catalyst 144 to the lesser boiling point fraction stream 108 in the second cracking reaction zone 142 may be different than the weight ratio of the first catalyst 124 to the greater boiling point fraction stream 106 in the first cracking reaction zone 122. The residence time of the mixture of second catalyst 144 and the lesser boiling point fraction stream 108 in the second cracking reaction zone 142 may be from 0.2 seconds (sec) to 3 sec, from 0.2 sec to 2.5 sec, from 0.2 sec to 2 sec, from 0.2 sec to 1.5 sec, from 0.4 sec to 3 sec, from 0.4 sec to 2.5 sec, or from 0.4 sec to 2 sec, from 0.4 sec to 1.5 sec, from 1.5 sec to 3 sec, from 1.5 sec to 2.5 sec, from 1.5 sec to 2 sec, or from 2 sec to 3 sec. In some embodiments, the residence time in the second cracking reaction zone 142 may be different than the residence time in the first cracking reaction zone 122.

Following the cracking reaction in the second cracking reaction zone 142, the contents of effluent from the second cracking reaction zone 142 may include second catalyst 144 and the second cracking reaction product stream 148, which may be passed to the second separation zone 150. In the second separation zone 150, the second catalyst 144 may be separated from at least a portion of the second cracking reaction product stream 148. In embodiments, the second separation zone 150 may include one or more gas-solid separators, such as one or more cyclones. The second catalyst 144 exiting from the second separation zone 150 may retain at least a residual portion of the second cracking reaction product stream 148.

After the second separation zone 150, the second catalyst 144 may be passed to the second stripping zone 152, where at least some of the residual portion of the second cracking reaction product stream 148 may be stripped from the second catalyst 144 and recovered as a second stripped product stream 154. The second stripped product stream 154 may be passed to one or more than one downstream unit operations or combined with one or more than one other streams for further processing. Steam 133 may be introduced to the second stripping zone 152 to facilitate stripping the second cracking reaction product stream 148 from the second catalyst 144. The second stripped product stream 154 may include at least a portion of the steam 133 introduced to the second stripping zone 152 and may be passed out of the second stripping zone 152. The second stripped product stream 154 may pass through cyclone separators (not shown) and out of the stripper vessel (not shown). The second stripped product stream 154 may be directed to one or more product recovery systems in accordance with known methods in the art, such as recycled by combining with steam 127. The second stripped product stream 154 may also be combined with one or more other streams, such as the second cracking reaction product stream 148. Combination with other streams is contemplated. For example, the first stripped product stream 134, which may comprise a majority steam, may be combined with steam 127. In another embodiment, the first stripped product stream 134 may be separated into steam and hydrocarbons, and the steam portion may be combined with steam 127. The spent second catalyst 146, which is the second catalyst 144 after stripping out the second stripped product stream 154, may be passed from the second stripping zone 152 to the regeneration zone 162 of the regenerator 160.

Referring to FIG. 3, the same type of catalyst may be used throughout the hydrocarbon feed conversion system 100, such as for the first catalyst 124 and the second catalyst 144. The catalyst (first catalyst 124 and second catalyst 144) used in the hydrocarbon feed conversion system 100 may include one or more fluid catalytic cracking catalysts that are suitable for use in the first cracking reaction zone 122 and the second cracking reaction zone 142. The catalyst may be a heat carrier and may provide heat transfer to the greater boiling point fraction stream 106 in the first cracking reaction zone 122 operated at high-severity conditions and the lesser boiling point fraction stream 108 in the second cracking reaction zone 142 operated at high-severity conditions. The catalyst may also have a plurality of catalytically active sites, such as acidic sites for example, that promote the cracking reaction. For example, in embodiments, the catalyst may be a high-activity FCC catalyst having high catalytic activity. Examples of fluid catalytic cracking catalysts suitable for use in the hydrocarbon feed conversion system 100 may include, without limitation, zeolites, silica-alumina catalysts, carbon monoxide burning promoter additives, bottoms cracking additives, light olefin-producing additives, other catalyst additives, or combinations of these components. Zeolites that may be used as at least a portion of the catalyst for cracking may include, but are not limited to Y, REY, USY, RE-USY zeolites, or combinations of these. The catalyst may also include a shaped selective catalyst additive, such as ZSM-5 zeolite crystals or other pentasil-type catalyst structures, which are often used in other FCC processes to produce light olefins and/or increase FCC gasoline octane. In one or more embodiments, the catalyst may include a mixture of a ZSM-5 zeolite crystals and the cracking catalyst zeolite and matrix structure of a typical FCC cracking catalyst. In one or more embodiments, the catalyst may be a mixture of Y and ZSM-5 zeolite catalysts embedded with clay, alumina, and binder.

In one or more embodiments, at least a portion of the catalyst may be modified to include one or more rare earth elements (15 elements of the Lanthanide series of the IUPAC Periodic Table plus scandium and yttrium), alkaline earth metals (Group 2 of the IUPAC Periodic Table), transition metals, phosphorus, fluorine, or any combination of these, which may enhance olefin yield in the first cracking reaction zone 122, second cracking reaction zone 142, or both. Transition metals may include "an element whose atom has a partially filled d sub-shell, or which can give rise to cations with an incomplete d sub-shell" [IUPAC, Compendium of Chemical Terminology, 2nd ed. (the "Gold Book") (1997). Online corrected version: (2006-) "transition element"]. One or more transition metals or metal oxides may also be impregnated onto the catalyst. Metals or metal oxides may include one or more metals from Groups 6-10 of the IUPAC Periodic Table. In some embodiments, the metals or metal oxides may include one or more of molybdenum, rhenium, tungsten, or any combination of these. In one or more embodiments, a portion of the catalyst may be impregnated with tungsten oxide.

Referring to FIG. 3, the first FCC unit 120 and the second FCC unit 140 may share the regenerator 160. The spent first catalyst 126 and the spent second catalyst 146 may be passed to the regenerator 160, where the spent first catalyst 126 and the spent second catalyst 146 are mixed together and regenerated to produce the regenerated catalyst 116. The regenerator 160 may include the regeneration zone 162, a catalyst transfer line 164, the catalyst hopper 174, and a flue gas vent 166. The catalyst transfer line 164 may be fluidly coupled to the regeneration zone 162 and the catalyst hopper 174 for passing the regenerated catalyst 116 from the regeneration zone 162 to the catalyst hopper 174. In some embodiments, the regenerator 160 may have more than one catalyst hopper 174, such as a first catalyst hopper (not shown) for the first FCC unit 120 and a second catalyst hopper (not shown) for the second FCC unit 140, for example. In some embodiments, the flue gas vent 166 may be positioned at the catalyst hopper 174.

In operation, the spent first catalyst 126 and spent second catalyst 146 may be passed from the first stripping zone 132 and the second stripping zone 152, respectively, to the regeneration zone 162. Combustion gas 170 may be introduced to the regeneration zone 162. The combustion gases 170 may include one or more of combustion air, oxygen, fuel gas, fuel oil, other components, or any combinations of these. In the regeneration zone 162, the coke deposited on the spent first catalyst 126 and the spent second catalyst 146 may at least partially oxidize (combust) in the presence of the combustion gases 170 to form at least carbon dioxide and water. In some embodiments, the coke deposits on the spent first catalyst 126 and spent second catalyst 146 may be fully oxidized in the regeneration zone 162. Other organic compounds, such as residual first cracking reaction product or second cracking reaction product for example, may also oxidize in the presence of the combustion gases 170 in the regeneration zone. Other gases, such as carbon monoxide for example, may be formed during coke oxidation in the regeneration zone 162. Oxidation of the coke deposits produces heat, which may be transferred to and retained by the regenerated catalyst 116.

The single catalyst regenerator 160 for regenerating the spent first catalyst 126 and the spent second catalyst 146 may improve the overall efficiency of the hydrocarbon feed conversion system 100. For example, cracking of the lesser boiling point fraction stream 108 in the second FCC unit 140 may produce less coke deposits on the spent second catalyst 146 compared to cracking of the greater boiling point fraction stream 106 in the first FCC unit 120. Combustion of the coke deposits on the spent second catalyst 146 during regeneration produces heat, but the amount of coke present on the spent second catalyst 146 may not be sufficient to produce enough heat to conduct the cracking reactions in the second cracking reaction zone 142. Thus, regeneration of the spent second catalyst 146 by itself may not produce enough heat to raise the temperature of the regenerated catalyst 116 to an acceptable second cracking temperature $T_{142}$ in the second cracking reaction zone 142. By comparison, the amount of coke formed and deposited on the spent first catalyst 126 during cracking of the greater boiling point fraction stream 106 in the first FCC unit 120 may be substantially greater than the coke deposits produced in the second cracking reaction zone 142. Combustion of the coke deposits on the spent first catalyst 126 during catalyst regeneration may produce sufficient heat to raise the temperature of the regenerated catalyst 116 (including the regenerated catalyst 116 produced from both the spent first catalyst 126 and the spent second catalyst 146) to high-severity conditions, such as a regenerated catalyst temperature $T_{116}$ equal to or greater than the first cracking temperature $T_{122}$ or the second cracking temperature $T_{142}$ for example, and may provide the heat required to conduct the cracking reactions in both the first cracking reaction zone 122 and the second cracking reaction zone 142.

The flue gases 172 may convey the regenerated catalyst 116 through the catalyst transfer line 164 from the regeneration zone 162 to the catalyst hopper 174. The regenerated catalyst 116 may accumulate in the catalyst hopper 174 prior to passing from the catalyst hopper 174 to the first FCC unit 120 and the second FCC unit 140. The catalyst hopper 174 may act as a gas-solid separator to separate the flue gas 172 from the regenerated catalyst 116. In embodiments, the flue gas 172 may pass out of the catalyst hopper 174 through a flue gas vent 166 disposed in the catalyst hopper 174.

The catalyst may be circulated through the first and second FCC units 120, 140, the regenerator 160, and the catalyst hopper 174. For example, the first catalyst 124 may be introduced to the first FCC unit 120 to catalytically crack the greater boiling point fraction stream 106 in the first FCC unit 120. During cracking, coke deposits may form on the first catalyst 124 to produce the spent first catalyst 126 passing out of the first stripping zone 132. The spent first catalyst 126 may have catalytic activity that is less than the regenerated catalyst 116, meaning that the spent first catalyst 126 may be less effective at enabling cracking reactions compared to the regenerated catalyst 116. The spent first catalyst 126 may be separated from the first cracking reaction product stream 128 in the first separation zone 130 and the first stripping zone 132. The second catalyst 144 may be introduced to the second FCC unit 140 to catalytically crack the lesser boiling point fraction stream 108 in the second FCC unit 140. During cracking, coke deposits may form on the second catalyst 144 to produce the spent second catalyst 146 passing out of the second stripping zone 152. The spent second catalyst 146 also may have a catalytic activity that is less than the catalytic activity of the regenerated catalyst 116, meaning that the spent second catalyst 146 may be less effective at enabling the cracking reactions compared to the regenerated catalyst 116. The spent second catalyst 146 may be separated from the second cracking reaction product stream 148 in the second separation zone 150 and the second stripping zone 152. The spent first catalyst 126 and spent second catalyst 146 may then be combined and regenerated in the regeneration zone 162 to produce the regenerated catalyst 116. The regenerated catalyst 116 may be transferred to the catalyst hopper 174.

The regenerated catalyst 116 passing out of the regeneration zone 162 may have less than 1 wt. % coke deposits, based on the total weight of the regenerated catalyst 116. In some embodiments, the regenerated catalyst 116 passing out of the regeneration zone 162 may have less than 0.5 wt. %, less than 0.1 wt. %, or less than 0.05 wt. % coke deposits. In some embodiments, the regenerated catalyst 116 passing out of the regeneration zone 162 to the catalyst hopper 174 may have from 0.001 wt. % to 1 wt. %, from 0.001 wt. % to 0.5 wt. %, from 0.001 wt. % to 0.1 wt. %, from 0.001 wt. % to 0.05 wt. %, from 0.005 wt. % to 1 wt. %, from 0.005 wt. % to 0.5 wt. %, from 0.005 wt. % to 0.1 wt. %, from 0.005 wt. % to 0.05 wt. %, from 0.01 wt. % to 1 wt. %, from 0.01 wt. % to 0.5 wt. % to 0.01 wt. % to 0.1 wt. %, from 0.01 wt. % to 0.05 wt. % coke deposits, based on the total weight of the regenerated catalyst 116. In one or more embodiments, the regenerated catalyst 116 passing out of regeneration zone 162 may be substantially free of coke deposits. As used in this disclosure, the term "substantially free" of a component means less than 1 wt. % of that component in a particular portion of a catalyst, stream, or reaction zone. As an example, the regenerated catalyst 116 that is substantially free of coke deposits may have less than 1 wt. % of coke deposits. Removal of the coke deposits from the regenerated catalyst 116 in the regeneration zone 162 may remove the coke deposits from the catalytically active sites, such as acidic sites for example, of the catalyst that promote the cracking reaction. Removal of the coke deposits from the catalytically active sites on the catalyst may increase the catalytic activity of the regenerated catalyst 116 compared to the spent first catalyst 126 and the spent second catalyst 146. Thus, the regenerated catalyst 116 may have a catalytic activity that is greater than the spent first catalyst 126 and the spent second catalyst 146.

The regenerated catalyst 116 may absorb at least a portion of the heat generated from combustion of the coke deposits. The heat may increase the temperature of the regenerated catalyst 116 compared to the temperature of the spent first catalyst 126 and spent second catalyst 146. The regenerated catalyst 116 may accumulate in the catalyst hopper 174 until it is passed back to the first FCC unit 120 as at least a portion of the first catalyst 124 and the second FCC unit 140 as at least a portion of the second catalyst 144. The regenerated catalyst 116 in the catalyst hopper 174 may have a temperature that is equal to or greater than the first cracking temperature $T_{122}$ in the first cracking reaction zone 122 of the first FCC unit 120, the second cracking temperature $T_{142}$ in the second cracking reaction zone 142 of the second FCC unit 140, or both. The greater temperature of the regenerated catalyst 116 may provide heat for the endothermic cracking reaction in the first cracking reaction zone 122, the second cracking reaction zone 142, or both.

As previously discussed, the hydrocarbon feed stream 102, such as crude oil for example, can have a wide range of compositions and a wide range of boiling points. The hydrocarbon feed stream 102 may be separated into the greater boiling point fraction stream 106 and the lesser boiling point fraction stream 108. The greater boiling point fraction stream 106 generally has a different composition than the lesser boiling point fraction stream 108. Thus, each of the greater boiling point fraction stream 106 and the lesser boiling point fraction stream 108 may require different operating temperatures and catalyst activities to produce desired yields of one or more petrochemical products or increase the selectivity of the reaction for certain products. For example, the greater boiling point fraction stream 106 may be more reactive and, thus, may require less cracking activity than the lesser boiling point fraction stream 108 to produce sufficient yields of or selectivity for a specific petrochemical product. The lesser cracking activity suitable for the greater boiling point fraction stream 106 may be provided by reducing the catalytic activity of the first catalyst 124 in the first cracking reaction zone 122, reducing the first cracking temperature $T_{122}$ in the first cracking reaction zone 122, or a combination of both. In contrast, the lesser boiling point fraction stream 108 may be less reactive and may require greater catalytic activity, such as an increased catalytic activity of the second catalyst 144 in the second cracking reaction zone 142, a second cracking temperature $T_{142}$ in the second cracking reaction zone 142 greater than the first cracking temperature $T_{122}$, or both, compared to the greater boiling point fraction stream 106 to produce sufficient yields of or selectivity for the specific petrochemical products.

As previously described in this disclosure, the hydrocarbon feed conversion system 100 may include a single regenerator 160 to regenerate the spent first catalyst 126 and the spent second catalyst 146 to produce the regenerated catalyst 116. Therefore, the regenerated catalyst 116 passed to the first FCC unit 120 is the same as and has the same catalytic effectiveness and temperature as the regenerated catalyst 116 passed to the second FCC unit 140. However, as previously discussed, the reaction conditions in the first FCC unit 120 or second FCC unit 140 for producing sufficient yields of or selectivity for specific petrochemical products may be different than the reaction conditions provided by passing the regenerated catalyst 116 to the other of the first FCC unit 120 or the second FCC unit 140.

EXAMPLES

The various embodiments of methods and systems for the conversion of feedstock fuels will be further clarified by the following examples. The examples are illustrative in nature, and should not be understood to limit the subject matter of the present disclosure.

Example A

Example A provides an example of a process in which the crude oil is hydrotreated, much like cycle oil may be hydrotreated in the presently disclosed embodiments. The effect of hydrotreating is illustrated with atmospheric resid in Table 2.

TABLE 2

| Properties | Units | Non Hydrotreated Amospheric Resid | Hydrotreated Amospheric Resid |
|---|---|---|---|
| API | — | 14 | 21.7 |
| Density @ 15° C. | g/cm³ | 0.9719 | 0.9231 |
| Nickel (Ni) | ppm (mg/kg) | 15.5 | 1.3 |
| Vanadium (V) | ppm (mg/kg) | 45.7 | 1.7 |
| Kinematic Viscosity @ 100° C. | cSt (mm²/s) | 44.09 | 129.2 |
| Carbon residue | wt % | 10.35 | 3.28 |
| Nitrogen | ppm (mg/kg) | 1920 | 770 |
| Total Sulfur | wt % | 3.78 | 0.3 |

As shown in Table 2, the hydrotreating process removed sulfur, nitrogen, along with metal contaminants. Specifically, as described in Table 2, the hydrotreating process removed sulfur from 3.78 wt. % to 0.3 wt. %, nitrogen from 1920 ppm to 770 ppm, vanadium from 45.7 ppm to 1.7 ppm.

Example B

Figure 4:
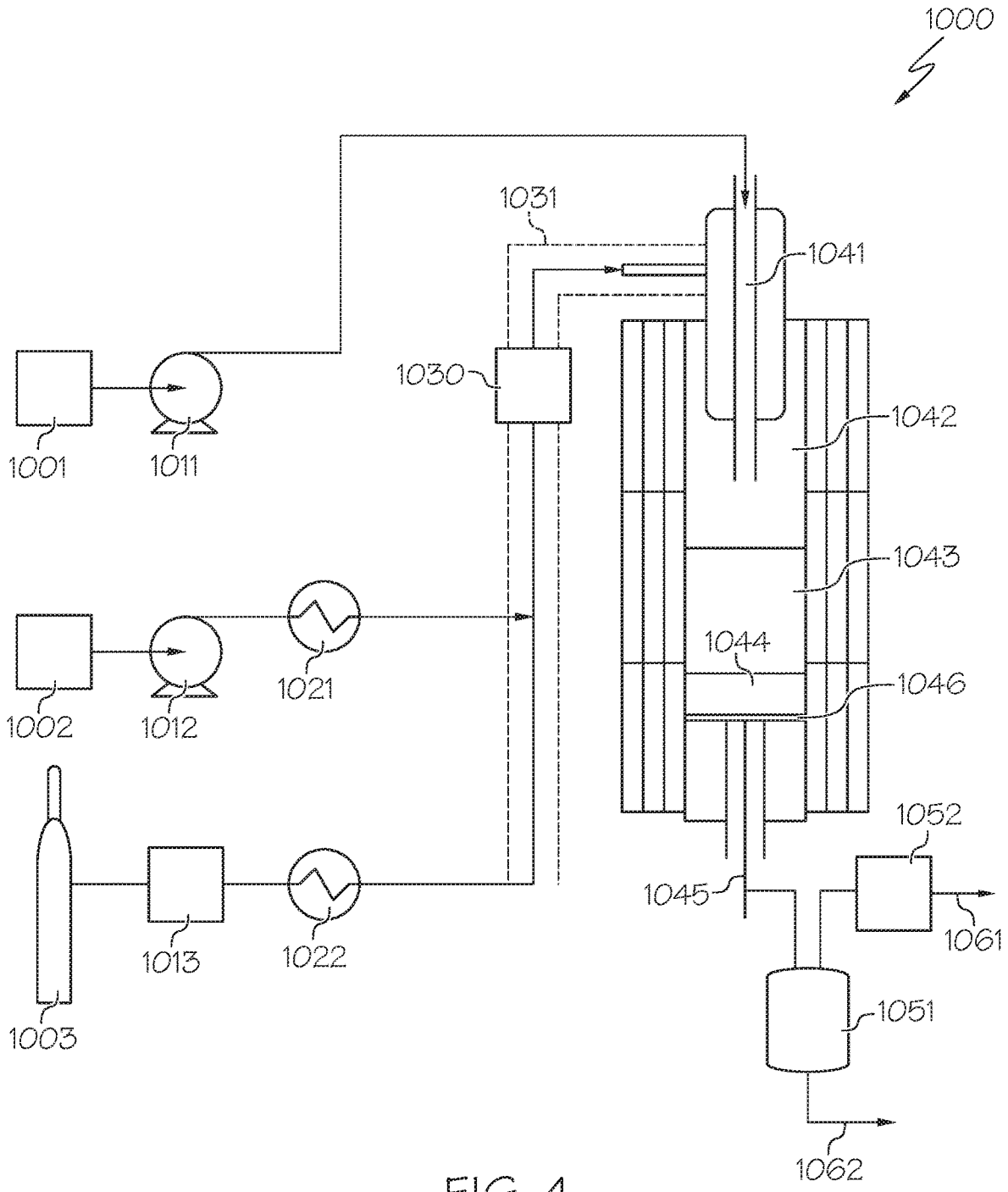
FIG. 4 is a generalized schematic diagram of a fixed-bed reaction system, according to one or more embodiments described in this disclosure.

Example B provides data related to the cracking of crude oil in the presence of steam and the absence of the steam. Experiments were carried out at atmospheric pressure in a fixed-bed reaction (FBR) system in the presence of steam and the absence of steam with Arabian Extra Light (AXL)

crude oil as feed. Referring to FIG. 4, AXL crude oil 1001 was fed to a fixed-bed reactor 1000 using a metering pump 1011. A constant feed rate of 2 g/h of AXL crude oil 1001 was used. Water 1002 was fed to the reactor 1000 using a metering pump 1012. Water 1002 was preheated using a preheater 1021. A constant feed rate of 1 g/h of water 1002 was used. Nitrogen 1003 was used as a carrier gas at 65 mL/min. Nitrogen 1003 was fed to the reactor 1000 using a Mass Flow Controller (MFC) 1013. Nitrogen 1003 was preheated using a preheater 1022. Water 1002 and Nitrogen 1003 were mixed using a mixer 1030 and the mixture was introduced to the reactor 1000. Prior to entering the reactor tube, oil, water, and nitrogen were preheated up to 250° C. in the pre-heating zone 1042. The pre-heating zone 1042 was pre-heated using line heaters 1031. Crude oil 1001 was introduced from the top of the reactor 1000 through the injector 1041 and mixed with steam in the top two-third of the reactor tube 1040 before reaching the catalyst bed 1044. The mass ratio of steam:oil was 0.5. The crude oil was cracked at a cracking temperature of 675° C. and a weight ratio of catalyst to oil of 1:2. The cracking catalyst was 75 wt. % Ecat and 25 wt. % OlefinsUltra® provided by W. R. Grace & Co-Conn. 1 g of catalyst of 30-40 mesh size were placed at the center of the reactor tube 1040, supported by quartz wool 1043, 1046 and a reactor insert 1045. Quartz wool 1043, 1046 were placed both at the bottom and top of the catalyst bed 1044 to keep it in position. The height of the catalyst bed 1044 was 1-2 cm. The reaction was allowed to take place for 45-60 min, until steady state was reached. Reaction conditions of the fixed-bed flow reactor 1000 are listed in Table 3. The cracking reaction product stream was introduced to a gas-liquid separator 1051. A Wet Test Meter 1052 was placed downstream of the gas-liquid separator 1051. The cracked gaseous products 1061 and liquid products 1062 were characterized by off-line gas chromatographic (GC) analysis using simulated distillation and naphtha analysis techniques. The reaction product streams from the cracking reaction were analyzed for yields of ethylene, propylene, and butylene. The yield analyses for Example B are subsequently Table 4.

TABLE 3

| Conditions | |
|---|---|
| Feed Used | AXL Whole Crude |
| Specific gravity of feedstock | 0.829 |
| API | 39.3 |
| Reaction apparatus | Fixed Bed Reactor |
| Weight hourly space velocity | 3 |
| Reaction temperature, ° C. | 675 |
| Reaction temperature Range, ° C. | 600-700 |

TABLE 4

| Product yield, Wt % | Catalytic Cracking (without steam) | Steam Enhanced Catalytic Cracking |
|---|---|---|
| Feed | AXL Whole Crude | AXL Whole Crude |
| Cracked gas | 51.4 | 60.4 |
| Fuel Gas (H2 + C1) | 7.6 | 7.8 |
| Ethylene | 12.0 | 18.8 |
| Propylene | 15.8 | 19.6 |
| Butylene (Butene) | 8.8 | 7.9 |
| Naphtha (C5 - 205° C.) | 27.7 | 16.9 |

TABLE 4-continued

| Product yield, Wt % | Catalytic Cracking (without steam) | Steam Enhanced Catalytic Cracking |
|---|---|---|
| LCO (205-330° C.) | 10.2 | 9.3 |
| HCO (330° C.) | 6.6 | 5.1 |
| Coke | 4.1 | 8.2 |

As shown in Table 4, the yield of ethylene, propylene, and butylene for the crude oil without steam was less than the yield for the crude oil with steam. The data for Example B suggests an opportunity for maximizing the yield of greater value petrochemical products through cracking the crude oil with steam.

A first aspect of the present disclosure is directed to a process for producing petrochemical products from a hydrocarbon material that includes separating the hydrocarbon material into at least a lesser boiling point fraction and a greater boiling point fraction and cracking at least a portion of the greater boiling point fraction in the presence of a first catalyst at a reaction temperature of from 500° C. to 700° C. to produce a first cracking reaction product. The process may further include cracking at least a portion of the lesser boiling point fraction in the presence of a second catalyst at a reaction temperature of from 500° C. to 700° C. to produce a second cracking reaction product. The process may further include separating cycle oil from one or both of the first cracking reaction product or the second cracking reaction product, where at least 99 wt. % of the cycle oil has a boiling point of at least 215° C., hydrotreating the cycle oil to form a hydrotreated cycle oil, and recycling the hydrotreated cycle oil by combining the hydrotreated cycle oil with the greater boiling point fraction upstream of the cracking of the greater boiling point fraction.

A second aspect of the present disclosure may include the first aspect, where the hydrotreating of the cycle oil removes at least a portion of metals, nitrogen, or aromatics content from the cycle oil to form the hydrotreated cycle oil.

A third aspect of the present disclosure may include either of the first or second aspects, where steam is combined with the greater boiling point fraction upstream of the cracking of the greater boiling point fraction, and steam is combined with the lesser boiling point fraction upstream of the cracking of the lesser boiling point fraction.

A fourth aspect of the present disclosure may include any of the first through third aspects, where at least 90 wt. % of the hydrocarbon material is present in the combination of the greater boiling point fraction and the lesser boiling point fraction.

A fifth aspect of the present disclosure may include any of the first through fourth aspects, where the difference between the 5 wt. % boiling point and the 95 wt. % boiling point of the hydrocarbon material is at least 100° C.

A sixth aspect of the present disclosure may include any of the first through fifth aspects, where the first cracking reaction product and the second cracking reaction product are combined to form a combined reaction product, and the cycle oil is separated from the combined reaction product.

A seventh aspect of the present disclosure may include any of the first through sixth aspects, further comprising separating at least a portion of the first cracking reaction product from a spent first catalyst, separating at least a portion of the second cracking reaction product from a spent second catalyst, regenerating at least a portion of the spent first catalyst to produce a regenerated first catalyst, and regenerating at least a portion of the spent second catalyst to produce a regenerated second catalyst.

An eighth aspect of the present disclosure may include any of the first through seventh aspects, where the hydrocarbon material is crude oil.

A ninth aspect of the present disclosure may include any of the first through eighth aspects, where the first cracking reaction product, the second cracking reaction product, or both, comprises at least one of ethylene, propene, butene, or pentene.

A tenth aspect of the present disclosure may include any of the first through ninth aspects, where the cut point of the lesser boiling point fraction and the greater boiling point fraction is from 180° C. to 400° C.

An eleventh aspect of the present disclosure is directed to a process for operating a hydrocarbon feed conversion system for producing petrochemical products from a hydrocarbon feed stream, the process comprising introducing the hydrocarbon feed stream to a feed separator, separating the hydrocarbon feed stream into at least a lesser boiling point fraction stream and a greater boiling point fraction stream in the feed separator. The process further includes passing the greater boiling point fraction stream to a first FCC unit, and passing the lesser boiling point fraction stream to a second FCC unit. The process further includes cracking at least a portion of the greater boiling point fraction stream in the first FCC unit in the presence of a first catalyst at a reaction temperature of from 500° C. to 700° C. to produce a first cracking reaction product stream, and cracking at least a portion of the lesser boiling point fraction stream in the second FCC unit in the presence of a second catalyst and at a reaction temperature of from 500° C. to 700° C. to produce a second cracking reaction product stream. The process further includes separating a cycle oil stream from one or both of the first cracking reaction product stream or the second cracking reaction product stream, where at least 99 wt. % of the cycle oil stream has a boiling point of at least 215° C., hydrotreating the cycle oil stream to form a hydrotreated cycle oil stream, and recycling the hydrotreated cycle oil stream by combining the hydrotreated cycle oil with the greater boiling point fraction upstream of the first FCC unit.

A twelfth aspect of the present disclosure may include the eleventh aspect, the hydrotreating of the cycle oil stream removes at least a portion of metals, nitrogen, or aromatics content from the cycle oil to form the hydrotreated cycle oil stream.

A thirteenth aspect of the present disclosure may include either the eleventh or twelfth aspects, where steam is combined with the greater boiling point fraction stream upstream of the cracking of the greater boiling point fraction stream, and steam is combined with the lesser boiling point fraction stream upstream of the cracking of the lesser boiling point fraction stream.

A fourteenth aspect of the present disclosure may include any of the eleventh through thirteenth aspects, where at least 90 wt. % of the hydrocarbon feed stream is present in the combination of the greater boiling point fraction stream and the lesser boiling point fraction stream.

A fifteenth aspect of the present disclosure may include any of the eleventh through fourteenth aspects, where the difference between the 5 wt. % boiling point and the 95 wt. % boiling point of the hydrocarbon feed stream is at least 100° C.

A sixteenth aspect of the present disclosure may include any of the eleventh through fifteenth aspects, where the first cracking reaction product stream and the second cracking reaction product stream are combined to form a combined reaction product stream, and the cycle oil stream is separated from combined reaction product stream.

A seventeenth aspect of the present disclosure may include any of the eleventh through sixteenth aspects, further comprising separating at least a portion of the first cracking reaction product stream from a spent first catalyst, separating at least a portion of the second cracking reaction product stream from a spent second catalyst, regenerating at least a portion of the spent first catalyst to produce a regenerated first catalyst, and regenerating at least a portion of the spent second catalyst to produce a regenerated second catalyst.

An eighteenth aspect of the present disclosure may include any of the eleventh through seventeenth aspects, where the hydrocarbon feed stream is crude oil.

A nineteenth aspect of the present disclosure may include any of the eleventh through eighteenth aspects, where the first cracking reaction product stream, the second cracking reaction product stream, or both, comprises at least one of ethylene, propene, butene, or pentene.

A twenty aspect of the present disclosure may include any of the eleventh through nineteenth aspects, where the cut point of the lesser boiling point fraction stream and the greater boiling point fraction stream is from 180° C. to 400° C.

For the purposes of defining the present technology, the transitional phrase "consisting of" may be introduced in the claims as a closed preamble term limiting the scope of the claims to the recited components or steps and any naturally occurring impurities.

For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter.

The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B and C should be interpreted as also disclosing a composition "consisting of" components A, B, and C as well as a composition "consisting essentially of" components A, B, and C.

Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a stream or in a reactor should be appreciated as containing, in some embodiments, a mixture of isomers of that constituent. For example, a compositional range specifying butene may include a mixture of various isomers of butene. It should be appreciated that the examples supply compositional ranges for various streams, and that the total amount of isomers of a particular chemical composition can constitute a range.

The subject matter of the present disclosure has been described in detail and by reference to specific embodiments. It should be understood that any detailed description of a component or feature of an embodiment does not necessarily imply that the component or feature is essential to the particular embodiment or to any other embodiment. Further, it should be apparent to those skilled in the art that various modifications and variations can be made to the described embodiments without departing from the spirit and scope of the claimed subject matter.

What is claimed is:

1. A process for producing petrochemical products from a hydrocarbon material, the process comprising:

separating the hydrocarbon material into at least a lesser boiling point fraction and a greater boiling point fraction;

cracking at least a portion of the greater boiling point fraction in the presence of a first catalyst at a reaction temperature of from 500° C. to 700° C. to produce a first cracking reaction product;

cracking at least a portion of the lesser boiling point fraction in the presence of a second catalyst at a reaction temperature of from 500° C. to 700° C. to produce a second cracking reaction product;

separating cycle oil from one or both of the first cracking reaction product or the second cracking reaction product, wherein at least 99 wt. % of the cycle oil has a boiling point of at least 215° C.;

hydrotreating the cycle oil to form a hydrotreated cycle oil; and recycling an entirety of the hydrotreated cycle oil by directly combining the hydrotreated cycle oil with the greater boiling point fraction upstream of the cracking of the greater boiling point fraction.

2. The process of claim 1, wherein the hydrotreating of the cycle oil removes at least a portion of one or more of metals, nitrogen, or aromatics content from the cycle oil to form the hydrotreated cycle oil.

3. The process of claim 1, wherein:

steam is combined with the greater boiling point fraction upstream of the cracking of the greater boiling point fraction; and steam is combined with the lesser boiling point fraction upstream of the cracking of the lesser boiling point fraction.

4. The process of claim 1, wherein at least 90 wt. % of the hydrocarbon material is present in the combination of the greater boiling point fraction and the lesser boiling point fraction.

5. The process of claim 1, wherein the difference between the 5 wt. % boiling point and the 95 wt. % boiling point of the hydrocarbon material is at least 100° C.

6. The process of claim 1, wherein:

the first cracking reaction product and the second cracking reaction product are combined to form a combined reaction product; and the cycle oil is separated from the combined reaction product.

7. The process of claim 1, further comprising:

separating at least a portion of the first cracking reaction product from a spent first catalyst;

separating at least a portion of the second cracking reaction product from a spent second catalyst;

regenerating at least a portion of the spent first catalyst to produce a regenerated first catalyst; and regenerating at least a portion of the spent second catalyst to produce a regenerated second catalyst.

8. The process of claim 1, wherein the hydrocarbon material is crude oil.

9. The process of claim 1, wherein the first cracking reaction product, the second cracking reaction product, or both, comprise at least one of ethylene, propene, butene, or pentene.

10. The process of claim 1, wherein the cut point of the lesser boiling point fraction and the greater boiling point fraction is from 180° C. to 400° C.

11. A process for operating a hydrocarbon feed conversion system for producing petrochemical products from a hydrocarbon feed stream, the process comprising:

introducing the hydrocarbon feed stream to a feed separator;

separating the hydrocarbon feed stream into at least a lesser boiling point fraction stream and a greater boiling point fraction stream in the feed separator;

passing the greater boiling point fraction stream to a first fluidized catalytic cracking unit;

passing the lesser boiling point fraction stream to a second fluidized catalytic cracking unit;

cracking at least a portion of the greater boiling point fraction stream in the first fluidized catalytic cracking unit in the presence of a first catalyst at a reaction temperature of from 500° C. to 700° C. to produce a first cracking reaction product stream;

cracking at least a portion of the lesser boiling point fraction stream in the second fluidized catalytic cracking unit in the presence of a second catalyst and at a reaction temperature of from 500° C. to 700° C. to produce a second cracking reaction product stream;

separating a cycle oil stream from one or both of the first cracking reaction product stream or the second cracking reaction product stream, wherein at least 99 wt. % of the cycle oil stream has a boiling point of at least 215° C.;

hydrotreating the cycle oil stream to form a hydrotreated cycle oil stream; and recycling an entirety of the hydrotreated cycle oil stream by directly combining the hydrotreated cycle oil with the greater boiling point fraction upstream of the first fluidized catalytic cracking unit.

12. The process of claim 11, wherein the hydrotreating of the cycle oil stream removes at least a portion of metals, nitrogen, or aromatics content from the cycle oil to form the hydrotreated cycle oil stream.

13. The process of claim 11, wherein:

steam is combined with the greater boiling point fraction stream upstream of the cracking of the greater boiling point fraction stream; and steam is combined with the lesser boiling point fraction stream upstream of the cracking of the lesser boiling point fraction stream.

14. The process of claim 11, wherein at least 90 wt. % of the hydrocarbon feed stream is present in the combination of the greater boiling point fraction stream and the lesser boiling point fraction stream.

15. The process of claim 11, wherein the difference between the 5 wt. % boiling point and the 95 wt. % boiling point of the hydrocarbon feed stream is at least 100° C.

16. The process of claim 11, wherein:

the first cracking reaction product stream and the second cracking reaction product stream are combined to form a combined reaction product stream; and the cycle oil stream is separated from combined reaction product stream.

17. The process of claim 11, further comprising:

separating at least a portion of the first cracking reaction product stream from a spent first catalyst;

separating at least a portion of the second cracking reaction product stream from a spent second catalyst;

regenerating at least a portion of the spent first catalyst to produce a regenerated first catalyst; and regenerating at least a portion of the spent second catalyst to produce a regenerated second catalyst.

18. The process of claim 11, wherein the hydrocarbon feed stream is crude oil.

19. The process of claim 11, wherein the first cracking reaction product stream, the second cracking reaction product stream, or both, comprise at least one of ethylene, propene, butene, or pentene.

20. The process of claim 11, wherein the cut point of the lesser boiling point fraction stream and the greater boiling point fraction stream is from 180° C. to 400° C.

21. The process of claim 1, wherein each of the lesser boiling point fraction and the greater boiling point fraction is catalytically cracked in a downflow reactor.

22. The process of claim 1, wherein a ratio of the greater boiling point fraction to the hydrotreated cycle oil is at least 0.05.

23. The process of claim 11, wherein each of the first fluidized catalytic cracking unit and the second fluidized catalytic cracking unit is a downflow reactor.

24. The process of claim 11, wherein a ratio of the greater boiling point fraction stream to the hydrotreated cycle oil stream is at least 0.05.

* * * * *